US008124026B2

(12) United States Patent
Lauks et al.

(10) Patent No.: US 8,124,026 B2
(45) Date of Patent: Feb. 28, 2012

(54) LATERAL FLOW DIAGNOSTIC DEVICES WITH INSTRUMENT CONTROLLED FLUIDICS

(75) Inventors: Imants Lauks, Ottawa (CA); Raymond J. Pierce, Ottawa (CA); James Wojtyk, Kingston (CA); Benoit R. Bergevin, Ottawa (CA)

(73) Assignee: Epocal Inc., Ottawa, Ontario (CA)

( * ) Notice: Subject to any disclaimer, the term of this patent is extended or adjusted under 35 U.S.C. 154(b) by 116 days.

(21) Appl. No.: 12/718,139

(22) Filed: Mar. 5, 2010

(65) Prior Publication Data

US 2010/0202926 A1 Aug. 12, 2010

Related U.S. Application Data

(62) Division of application No. 10/649,683, filed on Aug. 28, 2003, now Pat. No. 7,722,817.

(51) Int. Cl.
*B01L 3/00* (2006.01)

(52) U.S. Cl. ..... 422/500; 422/501; 422/502; 422/503; 436/180; 204/450; 204/600

(58) Field of Classification Search ..... 422/500–503; 436/180; 204/450, 600
See application file for complete search history.

(56) References Cited

U.S. PATENT DOCUMENTS

| | | | |
|---|---|---|---|
| 4,551,209 | A | 11/1985 | Lauks |
| 4,613,422 | A | 9/1986 | Lauks |
| 4,629,424 | A | 12/1986 | Lauks et al. |
| 4,739,380 | A | 4/1988 | Lauks et al. |
| 4,855,240 | A | 8/1989 | Rosenstein et al. |
| 4,864,229 | A | 9/1989 | Lauks et al. |
| 4,908,112 | A | 3/1990 | Pace |
| 4,933,048 | A | 6/1990 | Lauks |
| 4,954,087 | A | 9/1990 | Lauks et al. |
| 5,008,616 | A | 4/1991 | Lauks et al. |
| 5,009,766 | A | 4/1991 | Lauks |
| 5,063,081 | A | 11/1991 | Cozzette et al. |
| 5,075,078 | A | 12/1991 | Osikowicz et al. |
| 5,096,669 | A | 3/1992 | Lauks et al. |
| 5,112,455 | A | 5/1992 | Cozzette et al. |
| 5,120,643 | A | 6/1992 | Ching et al. |
| 5,124,661 | A | 6/1992 | Zelin et al. |

(Continued)

FOREIGN PATENT DOCUMENTS

WO 9958966 11/1999

(Continued)

OTHER PUBLICATIONS

Japanese Patent Application No. 2006-524190, Office Action Dated Aug. 4, 2009.

(Continued)

*Primary Examiner* — Jyoti Nagpaul
(74) *Attorney, Agent, or Firm* — Borden Ladner Gervais LLP

(57) ABSTRACT

Devices with lateral flow elements and integral fluidics are disclosed. The integral fluidics consist of injector pumps comprised of fluidic elements under instrument control. The fluidic element of an injector pump is fluidically connected to lateral flow elements and can be used to control fluid entry into containment chambers referred to as micro-reactors. The lateral flow elements comprise conductor elements that can be used for sample application and transport of analyte contained in the sample to the micro-reactor. Fluidic transport through the fluidic element of the injector pump is under instrument-control. Both the lateral flow element and the fluidic element may contain chemical entities incorporated along their length. The chemical reactions that can be used for analyte detection using the devices are described. Also described are methods of manufacture of these devices.

22 Claims, 9 Drawing Sheets

U.S. PATENT DOCUMENTS

| | | | |
|---|---|---|---|
| D332,833 | S | 1/1993 | Lauks et al. |
| 5,200,051 | A | 4/1993 | Cozzette et al. |
| 5,212,050 | A | 5/1993 | Mier et al. |
| D337,164 | S | 7/1993 | Lauks et al. |
| 5,416,026 | A | 5/1995 | Davis |
| 5,447,440 | A | 9/1995 | Davis et al. |
| 5,466,575 | A | 11/1995 | Cozzette et al. |
| 5,514,253 | A | 5/1996 | Davis et al. |
| 5,554,339 | A | 9/1996 | Cozzette et al. |
| 5,591,645 | A | 1/1997 | Rosenstein |
| 5,593,638 | A | 1/1997 | Davis |
| 5,605,664 | A | 2/1997 | Lauks et al. |
| 5,609,824 | A | 3/1997 | Lauks et al. |
| 5,614,416 | A | 3/1997 | Lauks et al. |
| 5,622,871 | A | 4/1997 | May et al. |
| 5,628,961 | A | 5/1997 | Davis et al. |
| 5,632,876 | A | 5/1997 | Zanzucchi et al. |
| 5,638,828 | A | 6/1997 | Lauks et al. |
| 5,653,243 | A | 8/1997 | Lauks et al. |
| 5,656,503 | A | 8/1997 | May et al. |
| 5,666,967 | A | 9/1997 | Lauks et al. |
| 5,753,517 | A | 5/1998 | Brooks et al. |
| 5,779,650 | A | 7/1998 | Lauks et al. |
| 5,783,401 | A | 7/1998 | Toledano |
| 5,789,253 | A | 8/1998 | Lauks et al. |
| 5,798,273 | A | 8/1998 | Shuler et al. |
| 5,821,399 | A | 10/1998 | Zelin |
| 5,837,446 | A | 11/1998 | Cozzette et al. |
| 5,837,454 | A | 11/1998 | Cozzette et al. |
| 5,997,817 | A | 12/1999 | Crismore et al. |
| 6,010,463 | A | 1/2000 | Lauks et al. |
| 6,013,164 | A | 1/2000 | Paul et al. |
| 6,030,582 | A | 2/2000 | Levy |
| 6,030,827 | A | 2/2000 | Davis et al. |
| 6,090,251 | A | 7/2000 | Sundberg et al. |
| 6,136,610 | A | 10/2000 | Polito et al. |
| 6,156,271 | A | 12/2000 | May |
| 6,171,067 | B1 | 1/2001 | Parce |
| 6,194,222 | B1 | 2/2001 | Buechler et al. |
| 6,306,594 | B1 | 10/2001 | Cozzette et al. |
| 6,306,642 | B1 | 10/2001 | Nelson et al. |
| 6,316,205 | B1 | 11/2001 | Guan et al. |
| 6,379,883 | B2 | 4/2002 | Davis et al. |
| 6,438,498 | B1 | 8/2002 | Opalsky et al. |
| 6,478,938 | B1 | 11/2002 | Paek et al. |
| 6,497,842 | B1 | 12/2002 | Takahashi et al. |
| 6,576,896 | B2 | 6/2003 | Figeys et al. |
| 6,750,053 | B1 | 6/2004 | Opalsky et al. |
| 7,074,610 | B2 | 7/2006 | Cozzette et al. |
| 7,201,833 | B2 | 4/2007 | Lauks et al. |
| 2002/0177958 | A1 | 11/2002 | Opalsky et al. |
| 2003/0010638 | A1 | 1/2003 | Hansford et al. |
| 2003/0127333 | A1 | 7/2003 | Lauks et al. |
| 2003/0170881 | A1 | 9/2003 | Davis et al. |
| 2004/0018577 | A1 | 1/2004 | Campbell et al. |
| 2004/0175296 | A1 | 9/2004 | Opalsky et al. |
| 2005/0054078 | A1 | 3/2005 | Miller et al. |
| 2006/0046275 | A1 | 3/2006 | Collier et al. |
| 2006/0160164 | A1 | 7/2006 | Miller et al. |
| 2007/0015977 | A1 | 1/2007 | McCann et al. |

FOREIGN PATENT DOCUMENTS

| | | |
|---|---|---|
| WO | 0249507 | 6/2002 |
| WO | 02/094440 A2 | 11/2002 |

OTHER PUBLICATIONS

U.S. Appl. No. 10/649,683, Notice of Allowance dated Dec. 28, 2009.
European Patent Application No. 04761732.9 Supplemental Search Report dated Jan. 12, 2012.

LATERAL FLOW DIAGNOSTIC DEVICES WITH INSTRUMENT CONTROLLED FLUIDICS

CROSS REFERENCE TO RELATED APPLICATIONS

This application is Divisional of U.S. patent application Ser. No. 10/649,683 filed on Aug. 28, 2003, which is incorporated herein by reference in its entirety.

FIELD OF THE INVENTION

The present invention relates generally to analytical devices and micro-arrays containing integral fluidic input/output devices for sample application and washing steps. More particularly, the present invention relates to the input/output fluidic devices constructed from planar solid-phase hydrophilic matrix circuits containing dry chemical reagents for use in point of care diagnostics and other micro-scale analyses.

BACKGROUND OF THE INVENTION

Lateral flow diagnostic devices including a micro-porous element along which a sample fluid flows laterally and a capture region for binding an analyte of interest contained in the sample fluid are known in the art. A lateral flow diagnostic device of simple construction includes a rectangular micro-porous strip, which supports capillary fluid flow along its length. Generally, quantitative and sensitive detection using such devices is limited. More recently, devices that incorporate instrumentation that allow for quantitative determination of the amount of analyte in a sample have been disclosed.

The lateral flow diagnostic strip has become widely used in assay techniques. In its simplest form the prior-art lateral flow device comprises a micro-porous strip element, which supports capillary flow of a fluid along its length. The strip has one end for application of a sample containing an analyte to be measured, a first region along its length containing a mobile reporter conjugate (typically a visually observable reporter such as colloidal gold conjugated to a first antibody directed against the analyte) and a second region containing a capture reagent (typically a second antibody directed against the analyte), and an effluent end. Sample fluid applied to one end of the strip flows along the strip to the first region where a complex is formed between the analyte and the reporter conjugate. The sample, including the mobile reporter conjugate-analyte complex, flows to the second region where the reporter conjugate-analtye complex is captured, while uncomplexed mobile reporter conjugate flows beyond the capture region towards the effluent end of the strip. The amount of visually detectable signal at the capture region is a measure of the amount of analyte in the sample. Prior art lateral flow devices are used in the above described sandwich immunoassay format as well as in an inhibition or competitive binding format.

Because prior-art lateral flow devices are inexpensive, give rapid results and are easy to use, they have been used in non-laboratory applications in so-called field-able, on-site testing or point of care diagnostic applications. Devices of the prior art have been routinely used for non-instrumented, non-quantitative diagnostic applications at the point of care, the presence of an analyte at or above a threshold concentration being determined by observing the appearance of a visible signal at the capture region. However, devices of the prior art are not generally suitable for use in quantitative assays for two reasons. Firstly, they are usually formatted with visually observable reporters, which are suitable for threshold yes/no detection, but unsuitable for quantitative analysis. Secondly, both the concentration of the complex formed between the analyte and the reporter conjugate and the amount of binding at the capture site are flow rate dependent. The variability of device operation, particularly sample flow rate and sample evaporation, creates significant variability in the detected signal.

Recently workers in the field have disclosed quantitative lateral flow devices incorporating instrumentation to measure the amount of signal at the capture site when using a chromophore reporter, or to measure the light emitted upon laser excitation of the capture region when using a fluorescent reporter (U.S. Pat. Nos. 5,753,517 and 6,497,842). U.S. Pat. Nos. 5,753,517 and 6,194,222 disclose instrumented quantitative lateral flow methods using internal controls incorporated into the flow path for internal calibration of variable factors, in particular variable flow rates. However, even quantitative prior-art lateral flow devices, have not matched the sensitivity of more complex laboratory based assays. There are three primary reasons for lower sensitivity. The first reason is the absence of rigorous wash steps, which may be required to fully remove unbound reporter conjugate from the capture region. The second reason is the absence of an amplification step. The third reason is the absence of a high sensitivity detection technique such as chemiluminescent detection. Because they are less sensitive, lateral flow devices are only used in routine analysis of higher abundance analytes. Low abundance analytes must still be measured on laboratory equipment, which incorporates rigorous wash steps, enzymatic signal amplification and extremely sensitive chemiluminescent detection techniques.

Lateral flow devices that account for some of these shortcomings are known in the prior art. U.S. Pat. No. 6,306,642 discloses a device with a primary lateral flow element for formation and capture of an enzyme-conjugate/analyte complex, and a supplementary lateral flow element containing a chromogenic substrate and a means of delaying the delivery of a chromogenic substrate to the capture region. U.S. Pat. No. 6,316,205 discloses a two-step lateral flow device with improved wash-out of unbound conjugate using a lateral flow element to which sample fluid is applied and an absorption pad separated by a removable barrier with a supplementary manual second step application of a wash fluid.

High sensitivity assays for detection of analtyes using multi-step procedures in conventional laboratory equipment are well known in the art. "Luminescence Biotechnology" eds. K. Van Dyke, C. Van Dyke and K. Woodfork, CRC Press, 2002, contains numerous examples of highly sensitive luminescence based assays. Enzyme immuno-assay kits based on membrane capture in a flow-through configuration (as opposed to lateral flow) are also known in the art. These kit-based devices typically require multiple reagent additions and wash steps and consequently are not well adapted to point-of care applications where a simple one-step procedure is preferable.

Flow-through type membrane based immunoenzymatic devices with a one-step format are now being developed. U.S. Pat. No. 5,783,401 discloses a device utilizing controlled transport membranes to provide the timed sequence of reaction steps in a multi-step enzyme immunoassay format.

Devices containing electro-osmotically pumped and pneumatically driven fluids in micro-channels (capillary dimensioned tubes, troughs and channels) are well known in the art. These devices are commonly referred to as 'lab-on-a-chip' devices (for example U.S. Pat. Nos. 4,908,112 and 5,180, 480). Reactions, mixture separations or analyses can take place in such microstructures in liquids that are electrokinetically or pneumatically transported along conduits. However, generally in these prior art devices, reagents are stored off-chip and need to be introduced during use. Also, devices of these technologies have generally operated in a continuous flow format because valves have been difficult to construct.

Electro-osmotically pumped solid hydrophilic matrix transport paths have been disclosed in U.S. Pat. Appl. Publ. No. 2002/0179448. Self-contained devices with integral reagents featuring electro-osmotically pumped lateral flow injection into micro-reactors have been disclosed in co-pending U.S Pat. Appl. Publ. No. 20030127333. U.S Pat. Appl. Publ. No. 2002/0123059 discloses a self-contained assay device with chemiluminescence detection based on pressure driven flow in micro-channels. Lateral flow immunochromatographic devices with electrochemical detection using integral electrodes have been disclosed in U.S. Pat. No. 6,478,938.

In summary, one-step prior art lateral flow diagnostic devices lack the amplification, washing and high sensitivity detection steps needed for quantitative determination of analyte levels. Micro-channel devices in the prior art have not incorporated chemical entities in the channels and reagents storage within the device. The prior art does not teach a one-step assay device that is as easy to use and inexpensive to manufacture but which features the more advanced fluidic capability found in high sensitivity quantitative laboratory-based assay technologies and in which assay performance is largely independent of the fluidic components and reaction vessels in which the assay is performed. This invention addresses the need to adapt standard lateral flow elements to incorporate more advanced fluidic elements for use in conjugate label application, washing, amplification and enhanced sensitivity detection without sacrificing the speed, simplicity of use and low cost of standard lateral flow technologies.

SUMMARY OF THE INVENTION

It is now an object of the present invention to address the above described sensitivity and variability problems inherent in the prior-art one-step diagnostic assay technology and to provide a more general platform for one-step testing.

It is another object of the present invention to provide an instrument-controlled integrated, diagnostic assay device, which can be used for quantitative one-step diagnostic testing and analyte detection.

It is still another object of the invention to provide an injector pump for controlled pumping of a fluid to a receiving location of a fluid receiving device, preferably a lateral flow path element of a diagnostic assay device. In the most basic preferred embodiment, the injector pump includes an initially dry, preferably micro-porous, fluidic path with a fluid application end for accepting fluid and an effluent end for delivering fluid to the receiving location, which fluidic path automatically fills with fluid up to the effluent end upon fluid application to the application end. The injector pump further includes a driving means for electro-osmotically pumping fluid out of the effluent end of the fluidic path and across the isolator. The driving means is preferably a pair of spaced apart first and second electrodes for the generation of an electric field to force fluid in the fluidic path after wet-up past the isolation element. In another preferred embodiment, the injector pump further includes an integrated isolation element for fluidically isolating the fluidic path at the effluent end from the fluid receiving location. The preferred isolation element or isolator is an air gap preventing capillary flow past the effluent end.

In the injector pump with the air gap, the application of the electrical potential forces the fluid across the air gap by electroosmosis when the micro-porous fluidic path has a surface charge and a zeta potential.

The first electrode is preferably in contact with the fluid in the fluidic path at a first location and the second electrode is positioned at a second, spaced apart location for electrical contact with the fluid at the application end.

During use of an integrated diagnostic device comprising such an injector pump, a fluid is applied to the fluid application end of the pump's fluidic path (either a sample fluid or another fluid which is preferably contained in an integral reservoir and transported therefrom to the application end of the element during the use of the device). Fluid fills the fluidic path by lateral capillary flow from its first fluid application end to its second effluent end. A voltage is then applied to two spaced apart electrodes, which voltage powers electro-osmotic flow through the fluidic path.

It is yet another object of this invention to teach an injector pump which has chemical entities such as mobilizable reagents incorporated along the length of the micro-porous fluidic path. Such chemical entities may be reporter conjugates, for example, which can react with analytes in the sample applied to the lateral flow device or they can be wash reagents or enzyme substrates. Chemical entities in the fluidic path are mobilized upon application of fluid to the path's application end and then pumped under instrument control into the lateral flow device. Preferred mobilizable reagents are luminogenic, fluorogenic, electrogenic, and chemiluminescent substrates.

It is still another object of this invention to provide a micro-assay device into which is incorporated an injector pump in accordance with the invention. The injector pump can be used to control fluid entry into other fluidic flow paths and to provide for at least one of reagent addition, washing and amplification steps of chemical reactions within the device.

It is another object of this invention to provide a micro-assay device into which fluidic elements are incorporated so as to provide for advanced fluidic manipulations. The fluidic elements comprise lateral flow elements supporting passive capillary flow and elements under instrument powered electro-osmotic lateral flow. There can be any number of both types of fluidic elements so long as one element is for sample application and so long as at least one element is part of an injector pump.

It is another object of the invention to provide a micro-assay device with flow elements having integrated chemical entities (such as reporter conjugates or enzyme substrates). The integrated chemical entities can be mobilized by application of fluid to the element, thereby either binding to analytes within the fluid if the fluid applied is sample and the mobilizable chemical entity is a reporter conjugate, or being transported along the element to one or more micro-reactor regions contained along the elements. When the chemical entities incorporated into the flow elements are enzyme substrates, these substrates may be luminogenic, fluorogenic, chromogenic or electrogenic. It is also possible to use a non-enzymatic label incorporated into the flow elements.

It is still another object of this invention to provide a single, integrated, diagnostic assay device containing some or all of the reaction chemicals and fluidics required to perform solution-based chemical reactions such as analyte labelling, capture, post-capture wash steps, amplification and high sensitivity detection.

It is yet a further object to teach how such a device can be manufactured by micro-fabrication. The means for detection is dependant upon the choice of chemical entity either applied using the injector pump, or incorporated into the flow elements.

It is still a further object to teach how integrated, diagnostic devices can be used to generate a signal, which can be detected and quantified by an external apparatus to which the device can be connected. The devices could be in the form of a diagnostic card containing an electrode module such as found in smart cards, which can be inserted into an external apparatus. The external apparatus provides for power to control fluid transport from one or more fluidic elements into micro-reactors within the device. The external apparatus can be connected to the diagnostic card in such a way to allow the products of the reaction occurring within the micro-reactors to be detected.

In a preferred embodiment, the injector pump is part of a micro-assay device and can be used to control fluid entry into other micro-channels within the device and to provide for reagent addition, washing and amplification steps of chemical reactions within the device. The pump will also be referred to herein as a second flow path.

Another preferred embodiment is a diagnostic device comprising an injector pump and a lateral flow element with a capture region along its length for binding analyte molecules contained within a sample fluid flowing through the lateral flow element. The injector pump provides for supplement actively pumped integral fluidics by providing wash, conjugate label application, amplification and detection of the captured complex. The lateral flow element comprises a sample application end and contains a micro-reactor region along its length.

In the one-step operation of the device of the invention, the user introduces sample to the diagnostic device and connects the diagnostic device to an external control instrument. Sample fluid is understood to be any chemical or biological aqueous fluid containing an analyte which is a chemical of interest to be analyzed. Sample fluid flows by capillary lateral flow through a fluidic element to an integral micro-reactor region of the device. Other reagents and wash fluids are then actively pumped to the micro-reactor region under instrument control and in timed sequence through other integral flow elements containing reagents that are also integral to the diagnostic device. The resulting device still retains the simplicity of the prior-art lateral flow device because it still only requires a simple one-step procedure by the user (all other steps being performed automatically by the instrument), and it is still low cost, but will now enable the quantitative determination of low abundance analytes.

Devices according to this invention can be configured in many different fluidic arrangements and in many different formats depending on the nature of the assay performed. In preferred embodiments of the invented diagnostic devices directed to sandwich type ligand-binding assays there are two types of assay format. In a first assay format a labelled conjugate is first reacted with an analyte in a sample fluid to form a complex, then the analyte-conjugate complex is captured for subsequent detection, the amount of captured complex detected being proportionate to the concentration of analyte in the sample. In a second assay format, the analyte is first captured then the captured analyte is reacted with a labelled conjugate with subsequent detection of the labelled capture complex.

In one preferred embodiment of the diagnostic assay device of the invention directed to a sandwich type ligand-binding assays in the format where the labelled conjugate reacts with analyte before capture, the integral, instrument-controlled fluidics of the device comprises a first micro-porous lateral flow element for flow of a sample fluid and at least one other micro-porous flow path for supplying another fluid to a fluid-receiving region of the first lateral flow element under instrument control. The first lateral flow element has a first end for sample application, and a second effluent end. There is an optional sample application pad and optional reagent application pad in fluidic contact with the first lateral flow element at its sample application end, and an optional fluid collection pad at its effluent end. The first lateral flow element may contain mobilizable dry reagents. For example, when performing a sandwich type ligand-binding assay, the mobilizable reagent in the first lateral flow element (or in the reagent pad in fluidic contact with it) may be a conjugate comprising a first agent that binds to an analyte (for example an antibody in an immunoassay or a nucleic acid in a nucleic acid assay) that is coupled to a label or reporter molecule (for example an enzyme reporter). There is a reaction region along the length of the first micro-porous element located in a micro-reactor containment means. The reaction region of the first micro-porous element may, for example, comprise a capture region containing immobilized second binding agent (a second antibody to the analyte in an immunoassay or a second nucleic acid in the case of a nucleic acid assay) that. The first micro-porous flow path element is also connected by a second flow path at a fluid-receiving location for injecting a second fluid, the second flow path being actively pumped under instrument control and generally, being part of an injector pump. The second flow path is a micro-porous element with a first end for fluid application and a second effluent end. It may be initially dry and may contain mobilizable dry reagents (for example, a substrate for the enzyme label in the ligand-binding assay). There is an air gap separating the effluent end of the second path from the fluid-receiving region of the first lateral flow element, which constitutes an isolation means.

During use of this device, sample fluid is applied to the application end of the initially dry first lateral flow element. Another fluid, a low conductivity aqueous electrolyte solution preferably contained in a sealed fluid reservoir integral to the device, is introduced into the initially dry second flow element from its fluid application end. The fluids flow by capillary flow through the two elements, dissolving or mobilizing the dry reagents therein, and fill the elements up to their effluent ends. In the ligand-binding assay example the mobilizable reagents include an enzyme labeled conjugate which binds with the analyte in the sample fluid as it flows along the first lateral flow element. A capture complex comprising the enzyme labeled analyte is formed in the micro-reactor region of the first flow element as the sample fluid containing enzyme labeled analyte complex traverses the micro-reactor region and binds to the immobilized binding agent at the capture site. Mobilizable reagents including enzyme substrate in the second flow path are transported to its effluent end as it fills by capillary flow. The isolation means assures that the fluid and mobile reagents in the second flow path are fluidically isolated from fluids and reagents in the first lateral flow element until such time that they are injected into the first lateral flow element at its fluid receiving location and thence to the micro-reactor region in the first lateral flow element by pumping under instrument control.

Instrument controlled injection from the second flow path to the first lateral flow element is by electro-osmosis in which case the pore surfaces of the micro-porous second flow path have a surface charge and zeta potential. The preferred method of providing power to drive electro-osmosis in the second fluidic path is with integral electrodes. The preferred electrical contact of the integral electrodes to the second fluidic path is one in which there is a field free region at the effluent end of the path. When the instrument-controlled pump power is supplied to the second flow path, fluid, including mobilizable reagents contained therein, is supplied to the micro-reactor region of the first flow element where the fluid reacts with fluid and reagents contained therein. In the enzyme labeled sandwich assay example the enzyme substrate supplied by the second flow path reacts with the enzyme label contained in the micro-reactor region of the first flow element to produce a detectable signal. A detector proximal to the micro-reactor measures the course of the reaction taking place in the micro-reactor which determines the concentration of an analyte contained in the sample fluid.

There are several possible high sensitivity detection formats in the known art appropriate for use in a device according to the invention. The enzyme substrate supplied to the micro-reactor region by instrument-controlled injection may be luminogenic, fluorogenic, or chromogenic. A luminogenic substrate reacts with the enzyme emitting a light signal, a fluorogenic substrate also emits a light signal but upon irradiation, and a chromogenic substrate reacts to produce a change in absorbance or reflection of incident light. In these cases, the proximal detector is preferably a light detector. It is also possible to use an electrogenic substrate for the enzyme label in which case the proximal detector is preferably an integral electrochemical detection electrode in contact with the micro-reactor region. It is also possible to use a non-enzymatic label such as a chemiluminescent acridinium ester compound known in the art. In that case, the reagent supplied to the micro-reactor region by instrument controlled injection is a known chemiluminescence triggering reagent and a light detector is preferably used to detect the product of the reaction.

The preferred detection format of this invention uses luminescence and the proximal detector is a light detector. When enzyme label is used in a luminescence detection scheme, the enzyme is preferably alkaline phosphatase in which case high sensitivity luminogenic substrates such as the known dioxetanes (for example adamantyl methoxy phenyl phosphate dioxetanes, AMPPD) can be used. Another possible known high sensitivity alkaline phoshatase substrate is luciferin-ortho-phosphate which is supplied to the capture region together with luciferase and ATP and magnesium ions. In this case the alkaline phosphatase decomposition of the luciferin phosphate produces luciferin which is enzymatically converted to bioluminescent light upon action by luciferase. Also possible is a galactosidase enzyme label and its adamantine-dioxetane luminogenic substrate. Another known high sensitivity assay format uses acetate kinase enzyme label, in which case its substrate acetylphosphate, ADP, luciferase and magnesium ion are supplied to the capture region. In this case acetate kinase catalysed formation of ATP is detected by the bioiluminescent luciferase reaction. In another example, the enzyme label may comprise horseradish peroxidase in which case enhanced luminol reagent known in the art may be used.

When an enzyme label is used in a fluorescence detection scheme, the enzyme is preferably alkaline phosphatase and the high sensitivity fluorogenic substrate methyl umbiferyl phosphate (MUBP) can be used. When an enzyme label is used in an electrochemical detection scheme, the enzyme is preferably alkaline phosphatase and the electrogenic substrate para amino phenyl phosphate can be used.

A preferred embodiment of the diagnostic device is a ligand-binding micro-assay device in which a labelled conjugate is first reacted with an analyte in a sample fluid to form a complex. The analyte-conjugate complex is captured for subsequent detection, the amount of captured complex detected being proportionate to the concentration of analyte in the sample. The first lateral flow element has enzyme-labelled conjugate as the mobilizable reagent. The enzyme-labelled conjugate binds with the analyte in the sample fluid as it flows along the first lateral flow element. A capture complex comprising the enzyme-labelled analyte is formed in the micro-reactor region of the first flow element as the sample fluid containing enzyme labelled analyte complex traverses the micro-reactor region and binds to the immobilized binding agent at the capture site. Mobilizable reagents including enzyme substrate in the second flow path are transported to its effluent end as it fills by capillary flow. The isolation means assures that the fluid and mobile reagents in the second flow path are fluidically isolated from fluids and reagents in the first lateral flow element until such time that they are injected into the first lateral flow element at its fluid-receiving location and thence to the micro-reactor region in the first lateral flow element by pumping under instrument control.

In the sandwich-type ligand-binding assay device, instrument-controlled fluid injection in the second flow path of such a device is by electro-osmosis. The pore surfaces of the micro-porous second flow path have a surface charge and zeta potential. When the instrument-controlled pump power is supplied to the second flow path, fluid, including mobilizable reagents contained therein, is injected into the first lateral flow element at its fluid receiving region. The fluid is transported to the first micro-reactor where it reacts with fluid and reagents contained within it. In a second step, instrument-controlled pump power is again supplied to the second flow path and the fluid in the first micro-reactor is transferred to the second micro-reactor where it reacts with reagents contained therein. A detector proximal to the second micro-reactor measures the course of the reaction taking place in the second micro-reactor which is a measure of the concentration of an analyte contained in the sample fluid.

An example of a two stage reaction that can be performed in the above device is the reaction using an enzyme substrate such as luciferin-ortho-phosphate. Luciferin-ortho-phosphate is supplied to the micro-reactor region of the first flow element containing a capture complex with an alkaline phosphatase enzyme label. After an incubation step, luciferin, the product of the reaction, is fluidically moved under instrument control to the second micro-reactor region containing luciferase, ATP and other assay reagents to produce a bioluminescent signal. Another possible two stage reaction uses an acetate kinase label and acetylphosphate substrate along with ADP and magnesium ions to produce ATP in a first incubation step. The ATP is then fluidically moved to a second micro-reactor containing luciferase and luciferin to produce the bioluminescent signal.

In an embodiment of the invention directed to analyte capture followed by labelling, the device preferably includes a first micro-porous lateral flow element containing a sample fluid application end and an effluent end and having a capture region along its length. The volume of the element is known and thence its fluid capacity. The device further includes multiple auxiliary fluidic paths for injection of fluids into the first lateral flow element. Each of the auxiliary flow path elements is capable of being independently actively pumped under instrument control. The auxiliary flow paths each comprise a micro-porous element with a first end for fluid application and a second effluent end. Each micro-porous element has a surface charge and a zeta potential and is contacted by integral electrodes for supplying instrument-controlled power to drive electro-osmosis. The preferred electrical contact location to each auxiliary fluid path is one in which there is a field free region at the effluent end of the path. Each auxiliary fluid path is initially dry and optionally contains mobilizable dry reagents. Each auxiliary fluid path has an air gap separating its effluent end from each of three fluid-receiving regions along the length of the first lateral flow element.

During use of this device, sample fluid is applied to the application end of the initially dry first lateral flow element. A second fluid, a low conductivity aqueous electrolyte solution preferably contained in an integral sealed fluid reservoir, is introduced into each initially dry auxiliary flow path element from its fluid application end. Sample fluid flows by capillary flow through the first lateral flow element. The second fluid fills each of the auxiliary flow path elements by capillary flow thereby mobilizing and transporting reagents to the effluent ends. The air gaps assure that the fluid and mobile reagents in the auxiliary flow paths are fluidically isolated from fluids and reagents in the first lateral flow path until such time that they are injected into the first flow element by pumping under instrument control. Subsequent instrument controlled fluid propulsion to the first flow element is by electro-osmosis. When instrument-controlled pump power is supplied to each of the auxiliary flow paths, fluid, including mobilizable reagents contained therein, is injected into the first lateral flow path.

In another embodiment of this device, there are three auxiliary actively pumped flow paths: a first for supplying a conjugate with an enzyme label, a second for providing a wash fluid and a third for providing an enzyme substrate to the capture region of the first fluidic element.

During use of this embodiment, sample fluid is applied to the fluid application end of the initially dry first lateral flow element and flows by capillary action along the element to the effluent end. The dissolved analyte to be assayed contained in the fluid is captured at the capture region along the length of the lateral flow element. The volume of fluid flowing over the capture region is known because the fluid fill volume of the element is known and controlled by the volume of the element downstream of the capture region.

In the next step, a first injection fluid containing enzyme labelled conjugate is injected from a first auxiliary flow path into the first lateral flow element at a first injection location along its length. The first injection fluid flows along the first lateral flow element towards the effluent end as well as towards the fluid application end. During this step sample fluid in the first lateral flow element is flushed out and replaced by the first injection fluid. The first injection fluid flows over the capture region and a sandwich complex is formed there when the labelled conjugate binds to the captured analyte.

In the next step, a second wash fluid is injected from a second auxiliary flow path into the first lateral flow element at a second injection location along its length. The second fluid flows along the first lateral flow path towards the effluent end. During this step the first injection fluid in the first lateral flow element is flushed out thereby removing excess unbound conjugate out of the capture region and replaced by the second wash fluid. Importantly, the first injection fluid containing excess unbound conjugate is flushed out of the capture region thus removing unbound label. In the next step performed under instrument control, a third injection fluid containing enzyme substrate is injected from a third auxiliary flow path into the first lateral flow element at a third injection location along its length. The third fluid flows along the first lateral flow path towards the effluent end as well as towards the fluid application end. During this step the wash fluid in the first lateral flow element is flushed out and replaced by the third injection fluid. When the third injection fluid containing enzyme substrate is moved so as to be located within the capture region, the instrument controlled injection stops. At this time the enzyme substrate reacts with the enzyme-labelled capture complex.

The reaction produces a detectable signal proportionate to the amount of captured complex which in turn is proportionate to the concentration of analyte in the sample. The signal is measured by a detection means located proximal to the capture region of the device. In an optional variant of the use of this device there is a wash step performed by instrument controlled injection of the wash fluid before injection of conjugate (to wash out sample fluid from the reaction region), as well as a wash step after injection of conjugate. Any of the above recited high sensitivity detection schemes can be used in this device.

Those skilled in the art will appreciate that there are numerous other fluidic arrangements and assay formats that can be contemplated using the inventive principles described in the above exemplar devices.

In general, an integral diagnostic device of this invention comprises a substrate with at least one signal generating micro-reactor (or micro-reactor array for multiplexed assays) and integral reagents and fluidics. A micro-reactor comprises a containment means for containment of an aqueous chemical reaction. The chemical reaction produces a detectable signal which determines the concentration of an analyte in a sample fluid. The micro-reactor may further comprise an optional capture region. Each micro-reactor has integral fluidics comprising a network of N fluidic input path elements and M fluidic effluent path elements. A fluidic path is an element through which fluid flows by capillary action. A fluidic path has a fluid input end through which fluid enters the element and a fluid effluent end through which it leaves the element. The N input fluidic paths and M effluent fluidic paths are initially dry elements and, during use of the device, are filled by lateral capillary flow when a fluid is applied to their fluid input end. In the array of micro-reactors each micro-reactor is connected to a fluidic network where the numbers N and M of input and output fluidic elements may be different for each micro-reactor.

In the first step during use of this diagnostic device, some or all of the initially dry N and M fluidic paths are filled with fluid by lateral capillary flow. At least one of the N and M paths is a injector. An injector is defined as a fluidic path element capable of being actively pumped under instrument control and which, after being filled by capillary flow from its fluid application end to its effluent end, is fluidically isolated at its effluent end from associated other fluidic elements (such as other fluidic paths and the micro-reactor) by an isolation means in the form of an air gap. The fluid does not flow beyond the effluent end of the path and the reagents in the path do not react with chemicals in other paths or in the micro-reactor until the fluid in the injector's flow path is actively pumped out (by instrument controlled means) beyond the isolation means at its effluent end to another fluidic element. Some of the N and M flow paths might also be active pump elements, that is, they are actively pumped by instrument-controlled pumping means, but they are non-injector elements, since they are not fluidically isolated. In actively pumped, non-injector elements, the effluent end of the fluid-filled element is in fluidic contact with other fluidic elements before applying instrument controlled pump power and there is no isolation means. Still other of the N and M flow paths might be passive pump elements that are not actively pumped by instrument controlled pumping means, but rather utilize non-instrument controlled passive pumping by a wicking device at their effluent ends. Still other paths are not pump elements at all: They fill from the dry state up to their effluent end and then the fluid does not move unless an external pressure is applied to drive fluid along the path. Some of the N and M flow paths may comprise micro-porous lateral flow materials, others may be empty channels or pipes as in conventional fluidic components.

Active pumping of pumped path elements is by electro-osmosis in which case the pumped path element should have at least a region with a charged capillary surfaces and a zeta potential. Power for active pumping is supplied by instrument controlled means and is preferably supplied through a pair of spaced apart integral electrodes, at least one of which contacts the pump's fluidic path along its length and the other contacts the path at another location along its length or contacts a fluid that is in electrical contact with the path's fluid at the application end.

Any or all of the initially dry fluidic path elements may contain dry reagents which are mobilized upon aqueous fluid introduction by capillary flow. If the path element is an actively pumped path element the mobilized reagents may then subsequently be transportable to another location under instrument control, in particular to a micro-reactor. Any or all of the paths may contain capture reagents which can capture and immobilize chemicals in the fluid contained therein.

In the above general embodiment at least one of the initially dry N fluid input paths is filled by capillary flow with sample fluid. Some or all of the other initially dry paths may be filled by capillary flow with sample fluid, or with a different aqueous fluid. When the fluid is different from sample fluid, the paths may be preferably filled with a fluid originating from at least one integral fluid source initially contained in at least one sealed reservoir which fluid is supplied to the input end of the paths during the use of the device.

Micro-reactors in various embodiments of the invention are reaction containment structures. A reaction containment structure assures that the contents of the reactor stay contained within a fixed location during the course of the reaction. A micro-reactor may be a region of a micro-porous flow path element, or a chamber or channel fluidically connected to a region of a flow path element. The chamber or channel may be enclosed or it may be vented to atmospheric pressure. A signal generating micro-reactor region contains a reaction which generates a signal proportionate to the concentration of an analyte to be determined. The location of the signal generating micro-reactor is proximal to a detector of the instrument used to monitor the course of the reaction.

In preferred embodiments of this invention for use in ligand-binding assay applications a lateral flow element for flow of a sample fluid comprises a micro-reactor region with a capture agent. In one embodiment of the invention a micro-reactor is a region of a micro-porous flow path element with an open-top reaction chamber. It comprises a planar slab element with an orifice mounted over a micro-porous flow path element, the slab's orifice being located over the flow path's reaction region. The side wall of the slab's hole forms the side wall of the micro-reaction well, and the planar substrate with the reaction region of the first flow path element forms the base of the micro-reaction well. The effluent end of at least one injector is located at the edge of the well with fluid being actively pumped into the well in a direction orthogonal to fluid flow within the first flow path element. As fluid fills the micro-reactor's containment-well, air is vented out through the open top. In another embodiment of a vented reaction chamber, the effluent end of the at least one injector is located outside the wall perimeter of the well, with an air gap between the effluent end of the injector's fluidic path and the well cavity. In another embodiment, the micro-reactor is a chamber or channel with a closed-top that intersects a reaction region of a micro-porous flow path. This intersecting chamber or channel may be enclosed or vented to atmospheric pressure. In another embodiment the micro-reactor is a region of a micro-porous fluidic path element, fluid being completely sealed at its perimeter.

There are various possible electrical contact locations. In one case the contacts are at two spaced apart locations along the length of the path. There is a first field-free region between the first fluid application end and the first contact, a region between the first and second contacts in which there is an electric field and a second field-free region between the second contact and the effluent end of the pump's path. In another case a first electrical contact is at the path's first application end (or even beyond it, making electrical contact outside of the path to the fluid which was applied to the first application end and in electrical contact with it), and a second contact is at a location along the length of the path, there being a region between the application end and the second contact in which there is an electric field and a field-free region between the second contact and the effluent end of the path. In a less desirable case, electrical contacts are located at each end of the element. In this case the fluid contained within the entire element is in the electric field.

It is often preferable to have a field-free space at the effluent end of the fluidic path. In this case, and when the initially dry path contains a mobilizable dry reagent, the dry reagent can be initially located anywhere along the length of the initially dry path. During use of a device with an injector with a field-free region at its effluent end, when fluid is applied to the pump path's first fluid application end, the initially dry path is filled by capillary flow and the mobilizable reagent is transported to the effluent end of the path stopping at the isolation means. When a voltage is applied to the path through its contact locations, the fluid in the path including the mobilizable reagent is pumped out of the effluent end. During the pumping process the mobilizable reagent is always located in the field-free region. In this arrangement, the reagent is not negatively influenced by the applied electrical power (it will not electrophorese if charged, and it will not react electrochemically at the electrodes).

An injector's electro-osmotic pump must propel fluid at useful speed independent of external perturbation and, if pumping a fluid load through a fluidically resistive element, often against a considerable back-pressure (for typical fluid load resistances of circuits of this invention the pressure at the effluent end of the pump can be of the order of 1 atmosphere above ambient pressure or even higher). To achieve this requirement it is necessary that the pump region of an injector (the region of the path between the electrode contact locations) should be micro-porous and have a zeta potential. A micro-porous flow path with pores smaller than a radius of 1 micron is typically required, preferably less than 0.2 microns. To operate efficiently and reproducibly, the micro-porous electro-osmotic pump region must be sealed by a perimetric sealing means. An unsealed micro-porous pump element or, in the limit, one that is a free standing micro-porous slab with perimetric air (an arrangement often encountered in lateral flow elements of the prior art) will not pump effectively against a back pressure because the fluid will be expelled from the pores of the slab in a perimetric direction as opposed to along the path and out of the effluent end.

There are two ways in which an injector may be configured relative to a fluid-receiving element at its effluent end. In both ways the injector's effluent end is initially separated from the fluid-receiving element of another fluidic element by an air gap. In a first configuration the effluent end of the injector, the air gap and the fluid-receiving region of another fluidic element are sealed into an enclosing chamber containing air. This chamber is not vented to the external atmosphere. Both the injector and the fluid-receiving element have been previously primed with fluid. As the injector is powered, its fluid is delivered out of its effluent end displacing the air in the air gap isolation region to elsewhere in the sealed chamber, allowing fluid to contact the receiving region of the fluid-receiving element. The air in the sealed chamber becomes pressurized, which pressure drives the injector fluid into the fluid-receiving element. When the pump is turned off, the compressed air in the non-vented chamber pushes the fluid both into the fluid-receiving element and back through the injector's flow path, returning the air gap to the region between the effluent end of the injector and the fluid-receiving element. This process can be accelerated by operating the injector's pump in reverse polarity, allowing the fluid in the chamber to withdraw more rapidly. After this process, the injector, now in its off-state, is again isolated (electrically and fluidically) from the fluid-receiving element. In this way there can be multiple injectors along the length of the sample fluidic element, each isolated when turned off, but fluidically connected when turned on. This allows for numerous individually pumped injectors being operated in sequence without cross-talk between pumps (which would be the case if they were permanently connected electrically and fluidically). Furthermore, an injector can be turned on under instrument control to pump fluid, then turned off returning it to its isolated off-state while other fluidic operations are performed in the device, and then turned on again to pump a second or even multiple subsequent times.

In a second configuration, the sealed enclosure is vented to the external atmosphere by an air vent channel. As the injector is powered, its fluid is pumped out of its effluent end displacing the air in the air gap isolation region out of the sealed chamber through the vent channel, allowing the injected fluid to contact the receiving region of the fluid-receiving element. The chamber remains at atmospheric pressure and the injected fluid is not pneumatically driven into the fluid-receiving element. Reagents in the injected fluid in contact with the fluid-receiving element can diffuse into the receiving element and react therein. After operation of an injection step performed in this configuration, the pumped fluid in the vented enclosure can be drawn back by the pump when it is operated in reverse polarity thus isolating the pump from the receiving fluidic element.

An air gap region at the effluent end of the flow path of an injector is a fluid isolation means. An air gap region is a space between the effluent end of the injector's flow path and another fluid-receiving element. When fluid is applied to the initially dry flow path of the injector at its fluid application end, the fluid flows by capillary flow to fill the path up to the effluent end, stopping at the air gap isolation means. The isolation means is effective in halting the capillary flow of fluid beyond the effluent end of the flow path. When the flow resistance of the injector's flow path (which is maximal when the pore size is small and flow path dimensions are long) is sufficiently large it impedes leakage flow through the injector in its off-state beyond the effluent end of the injector's path, even when there are pressure differences that may arise during the use of the diagnostic device across the input and effluent ends of the injector's path, or when there are capillary pumping forces that may arise during the use of the device created by the surfaces of other fluidic elements at the input and effluent end of the path. The air gap is preferably sized to ensure that any such incidental fluid leakage out of the injector during its off-state will not traverse the air gap thus removing the fluidic isolation. When the injector is in its on-state, a voltage is applied along the path of the fluid-filled injector, which path has a region with a surface charge and a zeta potential, fluid moves beyond the path's effluent end into the air gap region and beyond to the fluid-receiving element. The injector must then be capable of pumping at a useful speed (determined by the assay requirements) overcoming the back pressure created by the fluid-receiving element's flow resistance, and the air gap isolation means should be sized so that the injected fluid can traverse it in a useful time period.

A fluid-receiving element is an element connected to an injector's effluent end. It can be a micro-porous path or chamber element or a conventional open channel, pipe or chamber. The fluid-receiving element may be initially dry or filled with fluid at the time it receives fluid from the injector. If the fluid-receiving element is micro-porous and dry when it receives fluid from the injector, the received fluid will flow by capillary wicking along it. If the fluid-receiving element is already filled with fluid when it receives fluid from the injector, the received fluid will displace the existing fluid when the fluid-receiving region of the receiving element is connected to the injector at an enclosed air chamber. The fluid-receiving element may have a zeta potential and be connected by integral electrodes in which case the received fluid can be further electro-osmotically pumped along the receiving element or injected into another receiving element connected to it.

A micro-porous flow path of the invention may comprise a variety of different materials known in the art. Such materials have hydrophilic surfaces enabling capillary wicking of aqueous solutions. For example, micro-porous cellulose acetate, cellulose nitrate, polyethersulfone, nylon, polyethylene and the like may be used. The micro-porous flow path of an injector pump may be a single element or may contain more than one element in combination through which fluid can flow by capillary action. Micro-porous electro-osmotic injector elements should further comprise a material with a surface charge and a zeta potential. A preferred material is cellulose nitrate.

Sealing elements of the invention are electrically insulating materials which are capable of forming a fluidic seal around the perimeter of a flow path element. Die cut sealing elements for use in injectors of the invention may comprise any of the known pressure sensitive glue formulations available in sheet form such as siloxane or acrylic glues. These materials, when laminated around the injector form a seal upon re-flow under applied pressure. Many other insulating sealing materials which can be applied as a conformal coating when deposited from a solvent are appropriate for use in the invented devices.

Diagnostic devices with integral instrument controlled fluidics according to this invention can be manufactured in one of two ways. In a first way, the micro-porous flow path elements are formed from membrane sheets, for example by die cutting, and then assembled and sealed onto a planar substrate. In a second way, the flow path elements are produced in a thin film microfabrication process. In this technology a film of micro-porous material is formed on a planar substrate by a deposition technique such as spin coating from a solution of the membrane material dissolved in a solvent system appropriate to cause a phase inversion during the film's drying in the spin coating process. The phase inverted material is micro-porous. The resulting micro-porous dry film is then formed into flow path elements by a photolithographic process, which process includes the steps of coating with a photoresist, exposure and patterning of the photorestist and pattern transfer into the micro-porous film by a subtractive etch using a reactive gas plasma. Micro-fabrication materials and methods of forming micro-porous flow path elements and perimetric sealing means are disclosed in more detail in co-pending US Patent Application Publication No. 20030127333.

Dry reagents contained in specified locations of the micro-porous flow path elements can be deposited from a solution using nozzle micro-dispensing technology as is known in the art and practiced routinely in the manufacture of lateral flow devices and other membrane based dry reagent devices of the known art.

Another embodiment of the invention comprises an array of detection devices comprising an array of micro-reactors each having peripheral fluidics with at least one instrument controlled injector. In a preferred embodiment of this array the device is manufactured in micro-fabrication technology.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Figure 1A:
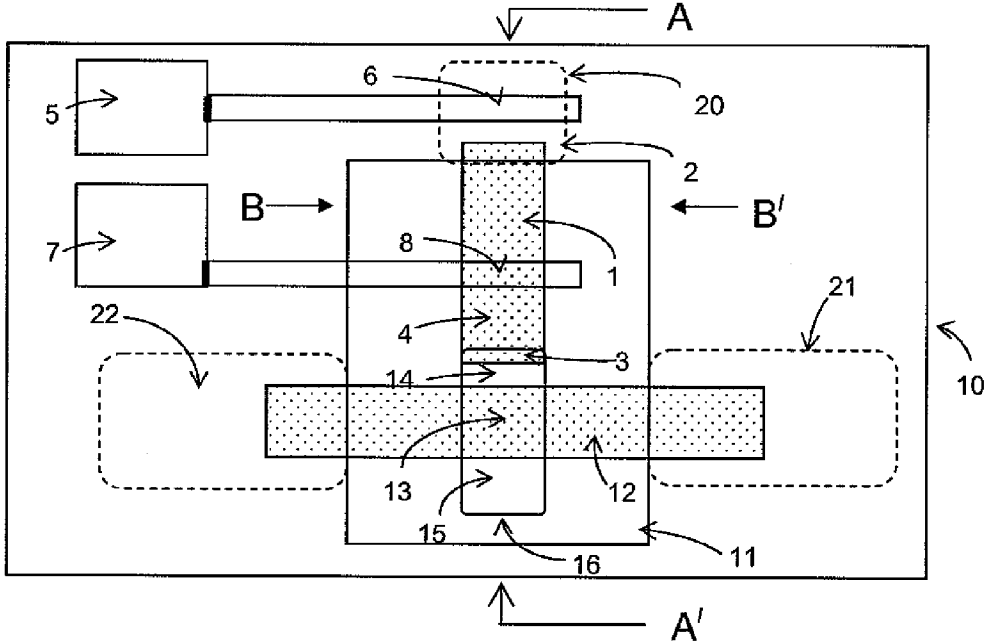
FIGS. 1A-C show a top view and cross-sectional view schematics of an instrument-controlled electro-osmotic injector comprising integral electrodes connected to a fluid-receiving element according to a preferred embodiment of the invention.
Figure 1B:
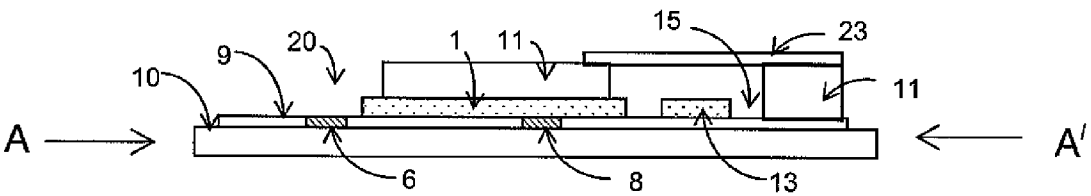

A schematic of an instrument controlled electro-osmotic injector as part of a diagnostic device of the invention is shown in FIG. 1. Throughout this detailed description section, the terms injector and injector pump are interchangeable. The terms fluidic path, fluidic element and fluidic path element are also interchangeable, as are the terms isolation element and isolator and the terms fluid receiving region and fluid receiving location. The top view schematic of FIG. 1A shows a substrate 10 with two integral electrodes for making electrical contact to an initially dry micro-porous fluidic path element 1. A first electrode has a contact pad 7 for connection to an electrical circuit and a contact location 8 for making electrical contact with the fluidic element 1 along its length. A second electrode has a contact pad 5 for connection to an external circuit and a contact location 6 near to the fluid application end 2 of element 1 for making electrical contact to the fluid applied to the fluid application end 2 of element 1. There is a first sealing element 9 covering the substrate 10 under the injector's fluidic path element 1 and under the fluid-receiving region 13 of a fluid-receiving element 12, but not covering the electrodes at contact locations 5, 6, 7 and 8. There is a second sealing element 11 covering the injector's fluidic path element but not at its fluid application end 2 or its effluent end 3. The second sealing element also covers a portion of the receiving element 12 but not at its fluid-receiving region 13.

Figure 1C:
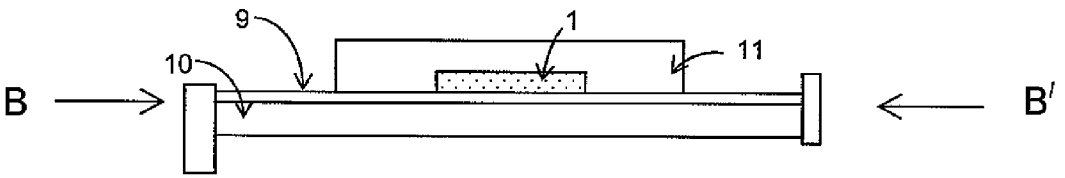

The first and second sealing elements 9 and 11 form a seal around the perimeter of the injector as shown in FIG. 1C which is a cross-sectional schematic through the section B-B' of FIG. 1A. There is a cover element 23 located over the opening in sealing element 11 at the location of the effluent end of 3 of the injector and the receiving region 13 of the fluid-receiving element 12. The cover element 22 is sealed to the second sealing element 11 forming an enclosed air chamber 15 surrounding the effluent end 3 of the injector and the receiving region 13 of the fluid-receiving element 12. There is an air gap isolation element 14 fluidically separating the effluent end 3 of the injector and the receiving region 13 of the fluid-receiving element 12. The fluid-receiving element is a micro-porous strip with one end connected to a fluidic circuit 21 and its other end connected to a fluidic circuit 22 comprising a sample fluid application region. There is a fluid injection location 13 along its length.

During use of a device comprising this injector, a sample fluid is applied to a sample fluid application region of the fluidic circuit 22. An electrical connection is made to an external electrical control circuit through contact pads 5 and 7. A fluid is applied to a fluid application region 20 of the device making electrical contact at contact location 6 of the electrode and making fluidic and electrical contact to the flow path element 1 at its fluid application end 2. The fluid flows by capillary wicking into element 1, filling it up to its effluent end 3 but not beyond. During this time, the fluid in the injector is fluidically isolated by air gap isolation element 14 from the fluid-receiving element 12 and all other fluidic circuits connected thereto and shown schematically as regions 21 and 22 in FIG. 1A. Instrument controlled power is applied to the electrodes. A voltage difference between the power electrode at contact location 8 and the grounded electrode at contact location 6 creates an electric field across the length of the fluidic element 1 between contact locations 6 and 8. This field drives electro-osmotic flow when the micro-porous material of element 1 has a zeta potential. When its surface charge and zeta potential are negative a negative voltage at contact location 8 will propel fluid from the fluid application region 20, through the injector's flow path and out of its effluent end 3. As fluid flows out of the effluent end, it displaces the air gap 14 towards end 16 of air enclosure 15 and compresses it. Fluid is now in contact with receiving region 13 of fluid-receiving element 12 and it is pumped into the receiving element 12 and fluidic circuits 21, 22 by pressurized chamber 15. Reagents contained in the injected fluid may react with chemicals contained in the fluid-receiving element 12 or in the fluidic circuits connected thereto. Reagents in the injected fluid may be contained in the fluid introduced into the injector from the fluid application region 20, or they may have been mobilized from dry reagent sources in the injector's path 1 when it was primed by capillary wicking of the fluid introduced from the application region 20. Preferably the dry reagent is located in the field free location 4. After instrument controlled pumping, the power on the electrode at contact location 8 is turned off or even reversed. Now the pressurized chamber 15 propels fluid back into pump element 1 and the pressurized air at end 16 of chamber 15 expands back to fill the chamber including the air gap region 14, thus returning the injector to its initial isolated off-state.

In an alternative embodiment of an injector and fluid-receiving element, the air chamber 15 is vented to ambient at location 16, for example through an orifice in cover 23 or along a conduit extending through sealing element 11. In this case, when instrument controlled power is applied to the injector's electrodes, fluid flows out of the effluent end 3 of element 1. The fluid displaces the air in the air gap region 14 to the vented end 16 of chamber 15 and fluid contacts the receiving region 13 of fluid-receiving element 12. Because the chamber is vented to atmosphere it is not pressurized in this case, and fluid is not pumped into element 12. However, there is diffusion of chemicals and reagents contained within the injector's pump fluid and the chemicals and reagents in the fluid-receiving region 13 of element 12. After instrument controlled pumping the power on the electrode at contact location 8 is reversed until the injected fluid in the chamber has returned into the injector and drawn air back to the air gap region, thus returning the pump to its initial off state.

Figure 2E:
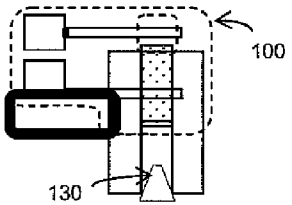
FIGS. 2A-H show top view schematics of instrument controlled electro-osmotic injectors comprising integral electrodes and their different modes of connection to single fluid-receiving elements.
Figure 2F:
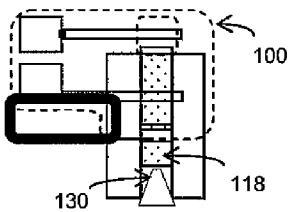
Figure 2G:
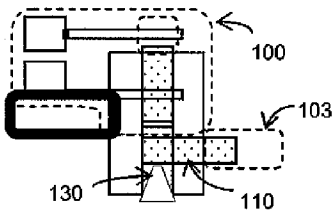
Figure 2H:
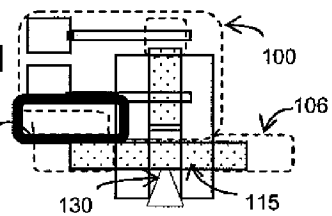
Figure 2A:
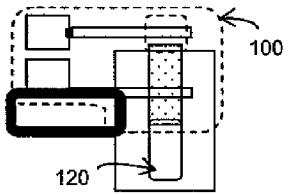
Figure 2B:
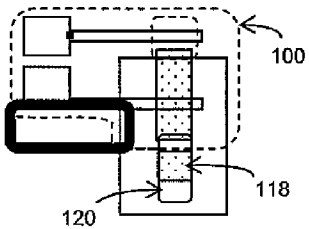
Figure 2C:
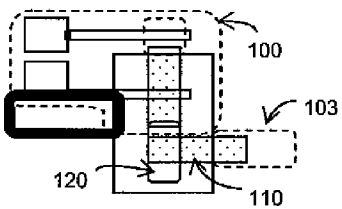
Figure 2D:
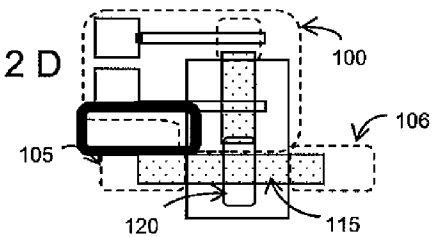
Figure 2O:
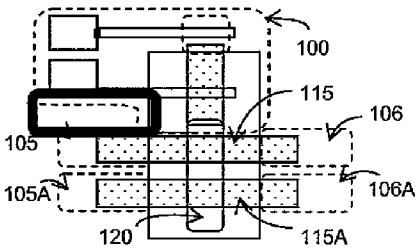
FIGS. 2I-Q are top view schematics of instrument controlled electro-osmotic injectors comprising integral electrodes and their different modes of parallel connection to two fluid-receiving elements.
Figure 2P:
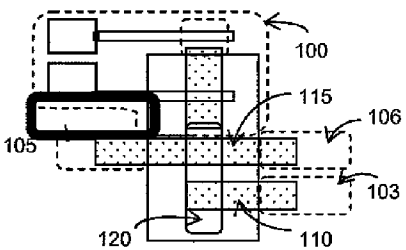
Figure 2Q:
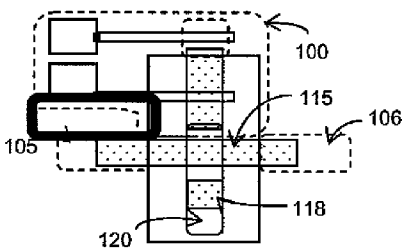
Figure 2L:
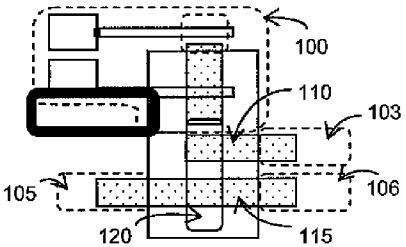
Figure 2M:
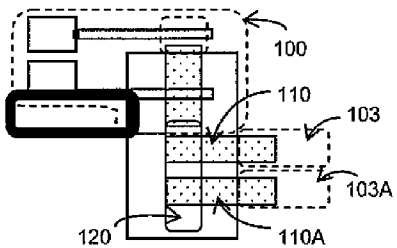
Figure 2N:
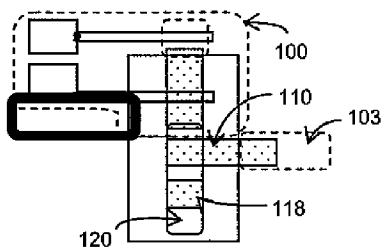

There are other possible configurations of an injector and fluid-receiving elements that utilize the above described injector. FIG. 2A-2S shows schematically some other ways of connecting an injector of the invention with fluid-receiving elements. In this figure there is shown a schematic injector comprising a sealed flow path, integral electrodes, a fluid application end and fluid application region and an effluent end with an air gap isolation member. These components are as described in FIG. 1 and are grouped in the dashed regions 100, 101 and 102 of FIG. 2A-2S. There are four configurations of injector and fluid-receiving elements depicted in FIG. 2A-2H. An injector with an air chamber at its effluent may be connected to no fluid-receiving elements (FIGS. 2A and 2E), or it may be connected to an element of one of three types. It may be connected to a fluid-receiving element 118 which stands alone and is not fluidically connected to other fluidic circuitry (FIGS. 2B and 2F). It may be connected to a fluid-receiving element 110, which is a flow path with one fluid-receiving end and another end connected to other fluidic circuitry 103 (FIGS. 2C and 2G). It may be connected to a fluid-receiving element 115 which is a flow path with both ends connected to fluidic circuitry (105, 106 being connected at either end of 115) and a fluid-receiving location along its length. FIGS. 2A-2D show fluid-receiving elements connected to an injector at an enclosed air chamber 120, while FIGS. 2E-2H show them connected at a vented air chamber 130. FIG. 2D is identical to the configuration depicted in FIG. 1.

An example of the configuration of FIG. 1 or 2D is a device comprising a lateral flow strip for transport of sample and an injector for instrument controlled injection into the strip. In this case 115 is the lateral flow strip, 105 contains a sample application region and 106 contains a sample effluent region. Lateral flow strip 115 may contain a capture region along its length which region constitutes the signal generating micro-reactor, and injector 100 may be used to inject a wash fluid, a conjugate or an enzyme substrate into the strip and through the capture region, as required to perform a ligand-binding assay.

FIGS. 2I-Q show how two fluid-receiving elements can be connected to a single fluid injector. The schematics depict a connection of an injector to two fluid-receiving elements in parallel at an enclosed air chamber. Similar parallel connections of multiple receiving elements to an injector are also possible when the air chamber is vented but they are not shown in FIG. 2.

Figure 2I:
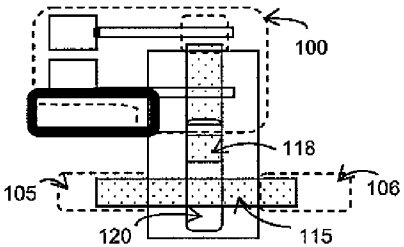
Figure 2J:
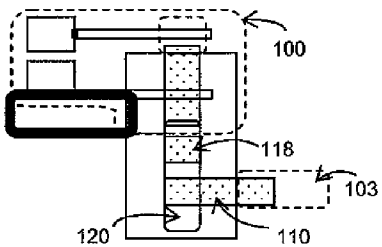
Figure 2K:
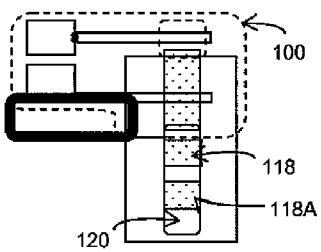

FIGS. 2I, 2J and 2K show connection of an injector to a first stand-alone fluid-receiving element 118 and a second parallel connection to a fluid-receiving element of each of the three types. FIGS. 2L, 2M and 2N show connection to the receiving end of a first flow path element 110 there being a fluidic circuit 103 at its other end, and a parallel connection to a second fluid-receiving element of each of the three types. FIGS. 2O, 2P and 2Q show connection to a first flow path 115 whose two ends are connected to fluidic circuits 105, 106 at a fluid-receiving location along its length, and a second parallel connection to a receiving element of each of the three types. It is clearly also possible to connect in parallel three or possibly more fluidic elements to a single injector, as might be necessary in some assay formats.

Figure 2R:
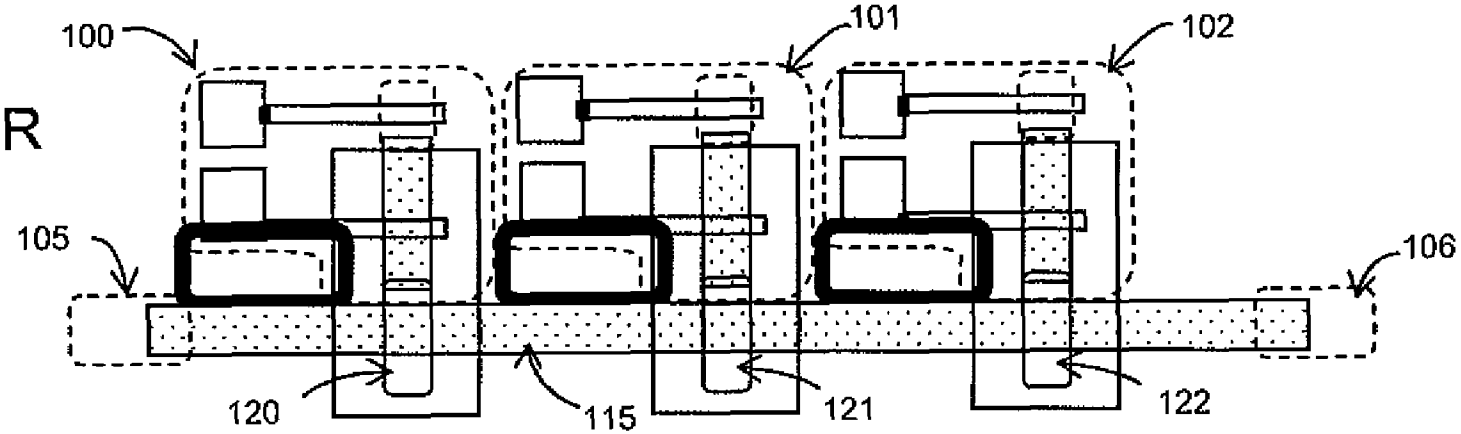
FIGS. 2R-S are top view schematics of multiple instrument controlled electro-osmotic injectors comprising integral electrodes and the different modes of connection to a single fluid-receiving element.
Figure 2S:
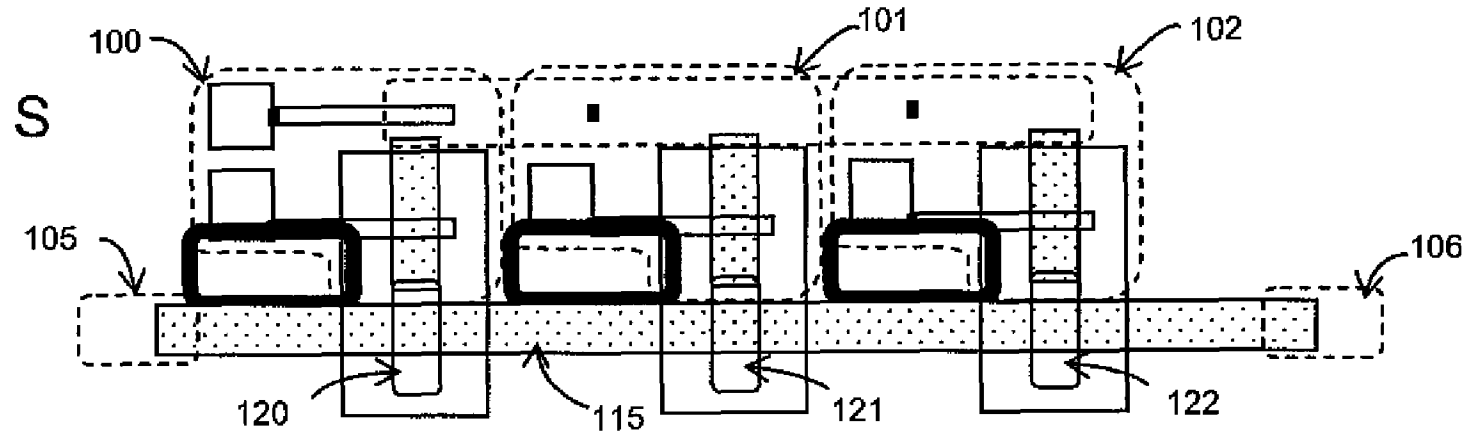

FIG. 2R depicts how multiple injectors may be connected to a single fluid-receiving element. In this schematic there is a fluid-receiving flow path 115 with fluidic circuitry 105 and 106 at its either end. There are three injectors 100, 101 and 102 which inject fluids at three locations along the length of the element 115. There is an enclosed air chamber at each of the injection locations 120, 121 and 122. The three ground electrodes of each of the three injectors may be connected independently from one another to each of three separate fluid application regions at the fluid application end of each injector element, as shown in FIG. 2R. More preferably, in FIG. 2S the three injector's ground electrodes are connected at one point to a single fluid application region that covers all three injectors' fluid application ends. This can be accomplished by a fluid application conduit.

An example of the configuration of FIGS. 2R and 2S is a device comprising a lateral flow strip for transport of sample and a multi-injector manifold for instrument controlled multiple fluid injections into the strip. In this case 115 is the lateral flow strip, 105 contains a sample application region and 106 contains a sample effluent region. Lateral flow strip 115 may contain a capture region along its length which capture region constitutes the signal generating micro-reactor. Injector 100 may be used to inject a fluid containing a reporter conjugate, injector 101 may be used to inject a wash fluid and injector 102 may be used to inject an enzyme substrate into the strip and through the micro-reactor region, as required to perform a sandwich type ligand-binding assay.

In general, a device of this invention comprises therefore at least one instrument controlled injector connected to a fluidic circuit through a fluid-receiving element according to any one of the configurations of FIG. 2. The device further comprises a sample application region for introducing sample fluid into the device's fluidic circuit and at least one signal generating micro-reactor region. This micro-reactor region may be contained within the fluid-receiving element or the fluidic circuits connected thereto. A detector proximal to the signal generating micro-reactor measures the course of the reaction taking place in the micro-reactor which determines the concentration of an analyte contained in the sample fluid. During use, the device of any of the variants of FIG. 2 is inserted into a receiving orifice of a detection instrument comprising a planar slab with an embedded light detector connected to an instrument means. The slab also has embedded spring loaded electrical contacts with one end connected to an electrical circuit in an instrument means and the other end contacting the electrodes' contact pads when the device is inserted into the orifice of the detection instrument. The device in the receiving orifice of the detection instrument has the detector's slab co-planar with the device substrate 10 and in close proximity, with the light detector located proximal to the signal generating micro-reactor region of the device. The detector slab and the substrate 10 form part of a dark cavity which lets in no external light.

Devices such as the exemplar device of FIG. 1 and variants shown in FIG. 2A-2S were constructed on a standard circuit board supporting electrodes for supplying electrical power to the fluidic circuit. Devices were fabricated on planar insulating epoxy substrates 10. The spaced apart electrodes were gold-plated copper electrodes which were 0.025 mm thickness copper plated with gold, fabricated in standard circuit board technology. Onto this was laminated a 0.025 mm thickness element 9 which was a silicone adhesive slab (Adhesives Research 8026) die cut from an adhesive sheet with openings over electrode contact locations 5, 6, 7, 8. The adhesive slab was assembled with its openings over the electrode contact locations resulting in a top surface that is approximately co-planar with the top surface of the metal of the electrode contact at each contact location. Micro-porous flow path elements 1, 12 die cut from a sheet were each about 0.15 mm in thickness. Element 1 was about 1 mm wide at its effluent end. It could be a rectangle as shown in FIG. 1 in which case its fluid application end also was about 1 mm wide. It could be a trapezoid in which case its fluid application end would be wider.

We generally have preferred trapezoid pumps with input to effluent width ratio of about 4:1 because they are capable of delivering higher pump rates. When element 12 is used to transport fluid to adjacent fluidic circuits 21, 22, it could be a rectangular strip of about 1-2 mm in width as shown in FIG. 1, although other shapes are possible depending on the specific performance requirement of the fluid-receiving element. When the fluid-receiving element is a micro-reactor, element 12 could be a square or a circular slab. Fluidic elements 1, 12 were assembled over the adhesive slab 9 with an air gap 14 of about 0.5 to several millimeters separating the effluent end 3 of fluid injection element 1 from the fluid-receiving element 12 at location 13. Depending on the type of experiment being performed, flow path element 1, 12 may be a die-cut strip from a sheet of micro-porous material as received from the manufacturer, and may be pre-treated by soaking (for blocking or introduction of surface charge) or impregnated with reagents at specific locations along its length.

Numerous materials with different porosity and surface treatment for the receiving element were used as discussed further herein. For the fluid injector element, cellulose nitrate with 0.22 micrometer pore diameter as received from the manufacturer is preferred because it has a high surface charge as required for efficient electro-osmotic propulsion. Next, a second silicone adhesive slab 11 was assembled over the micro-porous flow path elements. The adhesive slab 11 was 0.15 mm thickness made by laminating three layers of 0.05 mm layers (Adhesives Research 7876) and was die-cut from a sheet. It covered element 1 along its length, (but did not cover its fluid application end 2, the air gap region 14 or its effluent end 3), and it covered a portion of element 12, (but not at its fluid-receiving region 13 or a region 16 adjacent to it). A mylar cover element 23 was die-cut from a sheet and assembled over the opening in second sealing element 11 defined by regions 3, 4, 13 and 16 of FIG. 1, thus forming an enclosed air cavity 15.

In the final assembly step, the planar composite of slabs was compressed (60 PSI, 50° C. for 2 minutes). In this step the adhesive in slab 11 sealed to the adhesive in slab 9 and the cover slab 23, also sealing the elements 1 and 12 and importantly, with the sealant flowing around the element 1 and forming a perimeter seal in the region between the electrode contacts as is shown in the cross section BB' of FIG. 1C.

Various configurations of devices of FIGS. 1 and 2 were used to study instrument-controlled fluid injection to a receiving element and fluidic circuitry connected thereto as is described below.

Electro-Osmotic Pumping of Fluid from an Injector

Different configurations of the components of the injector of FIG. 1 (and the equivalent injector 100 of FIG. 2) were investigated. To operate to the required specification the injector should have the following characteristics: 1. reproducible capillary fill from the dry state when a fluid is applied to its application end; 2. no flow beyond its effluent end when there is no power being applied to drive electro-osmosis; and 3. reproducible flow at a useful flow rate beyond its effluent end when power is applied to the integral electrodes. The injector's flow path element was investigated with respect to its composition: material, surface treatment, porosity and pore size and with respect to its shape and dimensions. Integral electrodes were investigated with respect to their contact location and contact area. The air chamber was investigated with respect to its cavity dimensions, air gap dimensions, venting configuration. The effect of the above design parameters on initial capillary fluid fill rate during pump priming, the effectiveness of the flow arrestment at the effluent end of the pump element during the priming step and the subsequent electro-osmotic pumping characteristics as they depend on the fluid flow resistance of the element they are pumping into was investigated.

EXPERIMENT 1

Injection into a Vented Channel

To investigate the injector's pumping characteristics with no fluidic load injectors with a vented air channel at their effluent end but with no other fluid-receiving elements were constructed. This configuration is depicted in the schematic FIG. 2E. The injector was first primed by applying an aqueous fluid to the fluid application end of the initially dry injector. Next, a voltage was applied between the integral electrodes and the volume flow rate was measured by measuring the length of fluid in the vent channel of known cross-sectional area at different times. From this the electro-osmotic mobility (EOM) was obtained.

Best performance was obtained with injector fluids comprising aqueous solutions of low conductivity: an electrolyte concentration of about 2 mM was preferred and 10 mM was the upper useful range. A micro-porous cellulose nitrate/acetate (Millipore MF membrane GSWP) having a porosity of 0.75 with 0.11 micrometer pore radius was used as the injector's flow path. There was an integral anode ground electrode in contact with the fluid application end of the injector and an integral cathode electrode along the length of the injector's micro-porous fluid path. Injection fluids were typically about 2 mM aqueous buffer solutions comprising N-[2-hydroxyethyl]piperazine-N'-[2-ethanesulfonic acid] (HEPES) or diethanolamine (DEA) buffers. At a fixed voltage in the range 0-60 volts the pump rate was stable to a few percent over hundreds of seconds. There was no visible gas bubble formation in the fluid stream. The effect of pH on pump rate was minimal in the range 7>pH>10. At higher concentration of electrolyte, the pump rate was lower. Above about 10 mM the injector drew too much electrical current and could not operate at elevated voltages because there was gas bubble evolution into the flowing fluid emanating from the cathode. The concentration of the injector fluid's electrolyte affects the pump in two ways. As the concentration is increased the ionic strength increases and the Debye screening length goes down. This in turn diminishes the zeta potential and thus the EOM as is known in the art. Also, a higher electrolyte concentration results in a higher electrical conductivity of the injector fluid. The result is that at a given applied pump voltage there is a higher current draw causing a larger electrode polarization. As the electrodes polarize, more of the applied voltage drops across the electrodes and less across the micro-porous flow path element, resulting in a lower pump rate. The addition of redox active molecules to the injector fluid to reduce electrode polarization was investigated, but these limit the generality of the pump because they can interfere with the biochemical reactions taking place in the downstream microreactor(s). There is no significant electrode polarization (or gas evolution at the electrodes) when the injector is operated with gold electrodes and an injector fluid containing less than about 10 mM buffer electrolyte and no redox additives.

Priming of Injector with Injector Fluid:

An initially dry micro-porous flow path element of an injector is primed when injector fluid is applied to the injector's fluid application end. The fluid fills the element to its effluent end by capillary wicking. Using the preferred flow path material, which is a micro-porous cellulose nitrate/acetate with 0.11 micrometers pore radius, in an injector with a 5 mm long flow path element the fill time is within about 50 seconds.

Integral Electrode Location:

Generally, acceptable performance was obtained whenever the anode was close to the fluid application end. The best performance was obtained when the anode was immersed in the fluid outside of the injector's micro-porous path beyond its fluid application end but in electrical contact with it. The cathode location could be anywhere along the length of the injector's micro-porous flow path up to its effluent end, but optimal was about half to three quarters along the length towards the effluent end. This left a field free region beyond the cathode at the effluent end for possible location of dry reagents. When the cathode was too close to the anode at the fluid application end the electrical current was too high, limiting the device to low voltage and low pump rate operation. The typical area of the electrode contacts was 0.5×5 mm for the anode and 0.5×1 mm wide for the cathode.

Flow Path Shape and Dimensions:

Both rectangular and trapezoidal injector flow paths were investigated. A typical rectangular flow path element was about 4.25 mm long by 1 mm wide and 150 micrometers thickness cellulose nitrate/acteate with 0.7 porosity and 0.11 micrometer pore radius. An injector constructed with this flow path with an anode beyond the fluid application end and a cathode 3 mm from the fluid application end (1.25 mm from the effluent end), was operated with 2 mM DEA injector fluid. The pump rate, which was linear with applied voltage, was 0.5 nanoliters/second/volt. At a nominal operating voltage of 40 volts the pump rate was 20 nanoliters/second. A typical trapezoidal flow path was about 4.25 mm long, 4 mm wide at its fluid application end and 1 to 1.5 mm wide at its effluent end. When operated with the same electrode location and injector fluid the pump rate, which was linear with voltage, was 1.1 nanoliter/second/volt. At a nominal operating voltage of 40 volts the pump rate was 45 nanoliters/second. We have preferred to use trapezoidal injectors because of their higher pump rate but with similar effluent end geometry as the rectangular injector. The size of the effluent end is constrained by the size of the receiving fluidic element.

Flow Path Material and Surface Treatment:

Micro-porous cellulose nitrate/acetate (Millipore MF membrane GSWP) with 0.11 micrometer pore radius was found to have a superior and consistent EOM of about 2.5×10−8 m2/volt-sec when used with 2 mM DEA injector fluid. This corresponds with the 1.1 (0.5) nanoliter/second/volt pump rate of the trapezoidal (rectangular) injector. Other investigated materials had lower or zero EOM. A surface pre-treatment of low EOM materials, for example a pre-soak in an anionic surfactant such as ammonium dodecylsulfonate followed by drying could introduce surface charge and enhance the EOM. However, it is preferred to avoid such treatments as the surfactant can be expelled along with the injected fluid into the fluid-receiving element and fluidic circuitry connected thereto, potentially causing a deleterious effect on biochemical reactions occurring therein. This was particularly noticeable with the luciferase reaction described later. Accordingly, because the cellulose nitrate/acetate cited above could be used as is, without surface modification, it was preferred for the injector's flow paths.

EXPERIMENT 2

Injection into an Enclosed Chamber

Injectors with an enclosed air chamber at their effluent end but with no other fluid-receiving elements were constructed to investigate the injector's pumping characteristics with infinite fluidic load. This configuration is depicted in the schematic FIG. 2A. First, the injector was primed by applying an aqueous fluid to the fluid application end of the initially dry injector. Next, a voltage was applied between the integral electrodes. Fluid was displaced from the injector's effluent end into the enclosed channel of initial volume V1 and at P1=1 atmosphere. The air was compressed as the fluid filled the chamber until steady state when the fluid flow stopped. The new volume of air was V2<V1. The resulting pressure that stopped flow was calculated from Boyle's law to give P2=V1/V2. A micro-porous cellulose nitrate/acetate with 0.11 micrometer pore radius was used.

Pore Radius of Injector's Micro-Porous Flow Path:

Trapezoidal injectors (input end width 4 mm, effluent end width 1.5 mm, length 4.25 mm, thickness 0.15 mm) from micro-porous cellulose nitrate/acetate materials with 0.75-0.85 porosity and varying pore radii in the range 0.11 to 2.5 micrometers were constructed. Injectors were constructed with enclosed air chambers at their effluent ends. The pressure to stop flow at various pump voltages in the range 0-100 volts was measured. The pressure needed to stop flow increased approximately linearly with voltage. For small pore radius materials a larger back-pressure was required to stop flow as compared with the larger pore radius materials. An injector with a pore radius of 0.11 micrometers could pump against a back-pressure of 0.17 atmospheres/volt. At a typical working voltage of 40 volts the back-pressure to stop injector flow was 7 atmospheres. For a 2.5 micrometer pore radius material the back-pressure to stop injector flow was 0.01 atmospheres/volt. At a typical working voltage of 40 volts the back-pressure to stop injector flow was now only 0.4 atmospheres.

Sealing of the Injector:

The quality of the perimeter seal of the injector is important in obtaining good injector flow rates. In the case of an improper seal an air channel at the perimeter of the injector's flow path along its length will result in back-flow through the channel driven by the pressure difference between the effluent end and the fluid application end of the injector during electro-osmotic pumping. The result is a less stable and lower than expected electro-osmotic pump rate.

EXPERIMENT 3

Injection into a Fluid-Receiving Element at an Enclosed Air Chamber

Figure 3A:
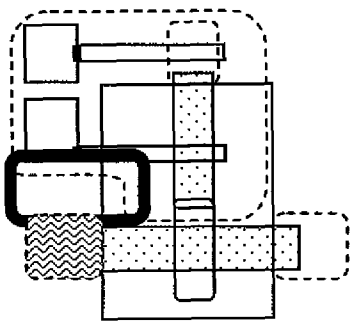
FIGS. 3A-G are top views of fluid flow schematics during the fluid injection operation of an injector connected to a fluid-receiving element.
Figure 3B:
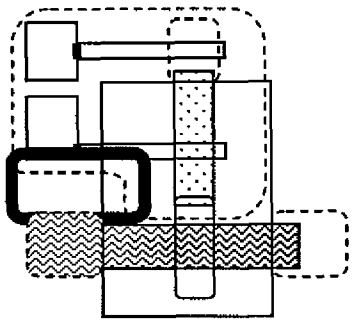
Figure 3C:
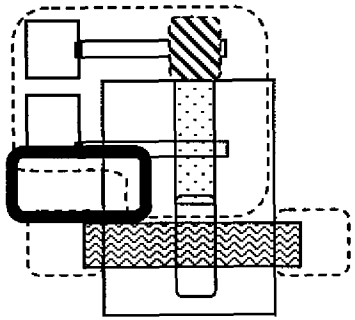
Figure 3D:
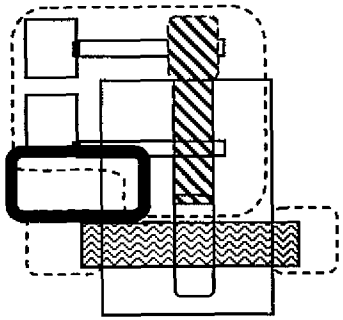
Figure 3E:
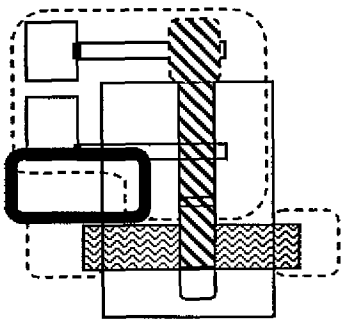
Figure 3F:
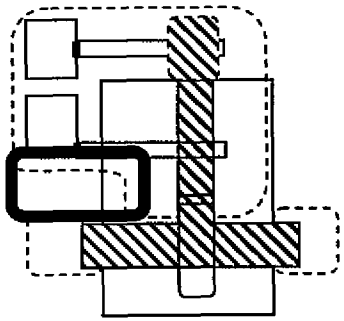
Figure 3G:
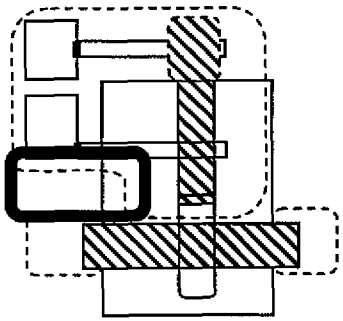

To investigate the pumping characteristics of an injector connected to a fluid-receiving element with a flow resistance injectors with an enclosed air chamber at their effluent end connected to a fluid-receiving strip element at a fluid-receiving location along its length were constructed. Both rectangular and trapezoidal injectors were investigated. The configuration of injector and fluid-receiving element is as depicted in the schematic FIG. 2D. The various steps in the operation of the injector of this configuration are depicted in FIG. 3A-3E. A first fluid was applied to the fluid application end of the initially dry strip (FIG. 3A). The strip was filled with the first fluid by lateral capillary flow (FIG. 3B). Next, the initially dry injector was primed by applying an aqueous fluid (2 mM DEA solution) to its fluid application end (FIG. 3C). The injector filled to its effluent end by capillary flow (FIG. 3D). A voltage was applied between the integral electrodes. Fluid was displaced from the injector's effluent end into the enclosed chamber of initial volume V1 and at P1=1 atmosphere. The air in the enclosed chamber was compressed as the fluid filled the chamber until steady state when compression stopped (FIG. 3E). At this steady state there was flow of fluid along the fluid-receiving strip towards both of its ends, (fluid flowing towards regions 105 and 106 of FIG. 2C), as shown in FIG. 3F. The new volume of air in the chamber was V2<V1. The resulting steady state pressure was calculated from Boyle's law to give the air chamber pressure P2=V1/V2. After the fluid injection step the voltage was switched off and the compressed air in the air chamber recovered to its position at the effluent end of the injector, thus fluidically and electrically isolating the injector fluid from the fluid in the fluid-receiving element (FIG. 3G).

Figure 4B:
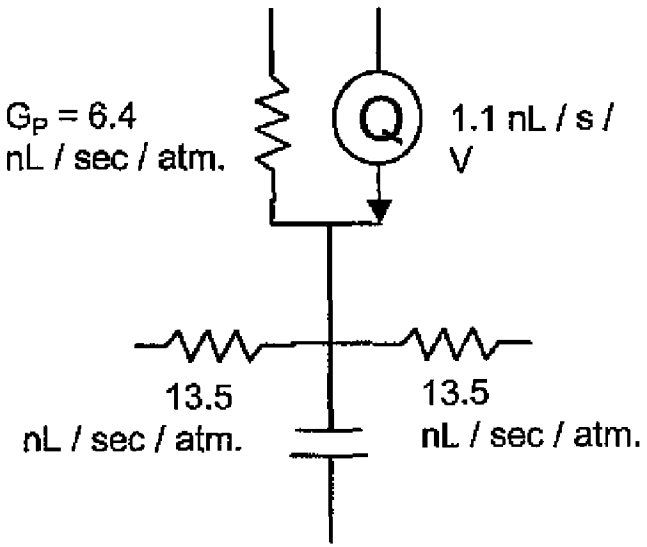
FIGS. 4A-B are a top view schematic of an injector connected to a fluid-receiving element including dimensions in millimeters, and the device's fluid flow equivalent circuit respectively.
Figure 4A:
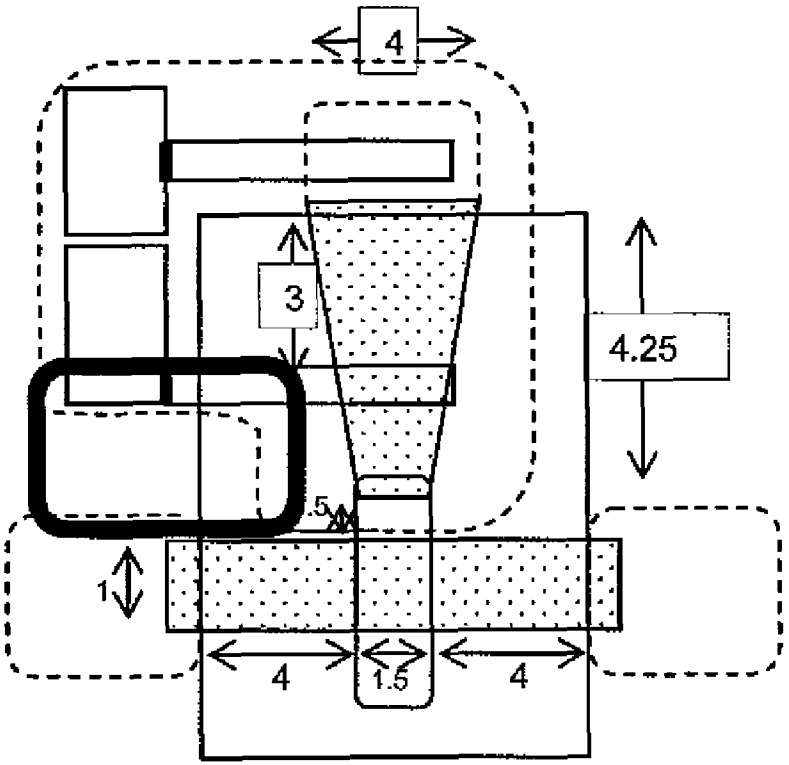

For the configuration shown in FIG. 4 which shows a trapezoidal injector (inlet width 4 mm, effluent end width 1.5 mm, length 4.25 mm, thickness 0.15 mm) that used a microporous cellulose nitrate/acetate for the injector's fluidic path (porosity 0.7, pore radius 0.11 micrometer) and a microporous polyethersulfone fluid-receiving strip (1 mm wide by 9 mm long with a 1 mm long fluid-receiving region at a central location along its length and 4 mm length extending on either side of the fluid-receiving location, thickness 0.15 mm, with pore radius of 0.25 micrometers). The pressure at steady state flow increased linearly with applied voltage at 0.03 atmospheres/volt.

Injector's Specifications:

To better understand how the injector's performance depends on the injector's design parameters consider a model injector comprising an injector flow path that has been primed with fluid by capillary flow from its application end up to its effluent end. The injector flow path comprises a trapezoidal slab of length L, width w at its effluent end and W at its fluid application end, and height h of a micro-porous material of porosity, pore channel tortuosity and pore radius a. There is a first electrode at the injector's fluid application end (or in a fluid beyond the fluid application end but fluidically connected to it). There is a second electrode along the length of the injector's flow path at a distance l from the input and consequently there is a region whose length is L−l at the effluent end that is field-free. The flow rate Q of a fluid of viscosity is given by $$Q = \frac{\psi h(W-w)}{L\tau \ln(W/w)}\left(V\mu_{eo} - P\frac{a^2}{8\eta}\right) \quad \text{equation 1}$$

which simplifies to equation 2 for a rectangular slab of width w $$Q = \frac{\psi hw}{L\tau}\left(V\mu_{eo} - P\frac{a^2}{8\eta}\right) \quad \text{equation 2}$$

The first term is the electro-osmotic flow when V is the voltage applied along the length l and $_{eo}$ is the electro-osmotic mobility (EOM). The second term is the pressure driven flow when there is a pressure difference P across the length of the slab (positive P is a back-pressure that causes flow in the opposite direction to electro-osmotic flow). The electro-osmotic flow rate depends on the total slab length L and not on the electrode separation, but the electric current that the pump draws at the applied pump voltage increases as l decreases.

Figure 5:
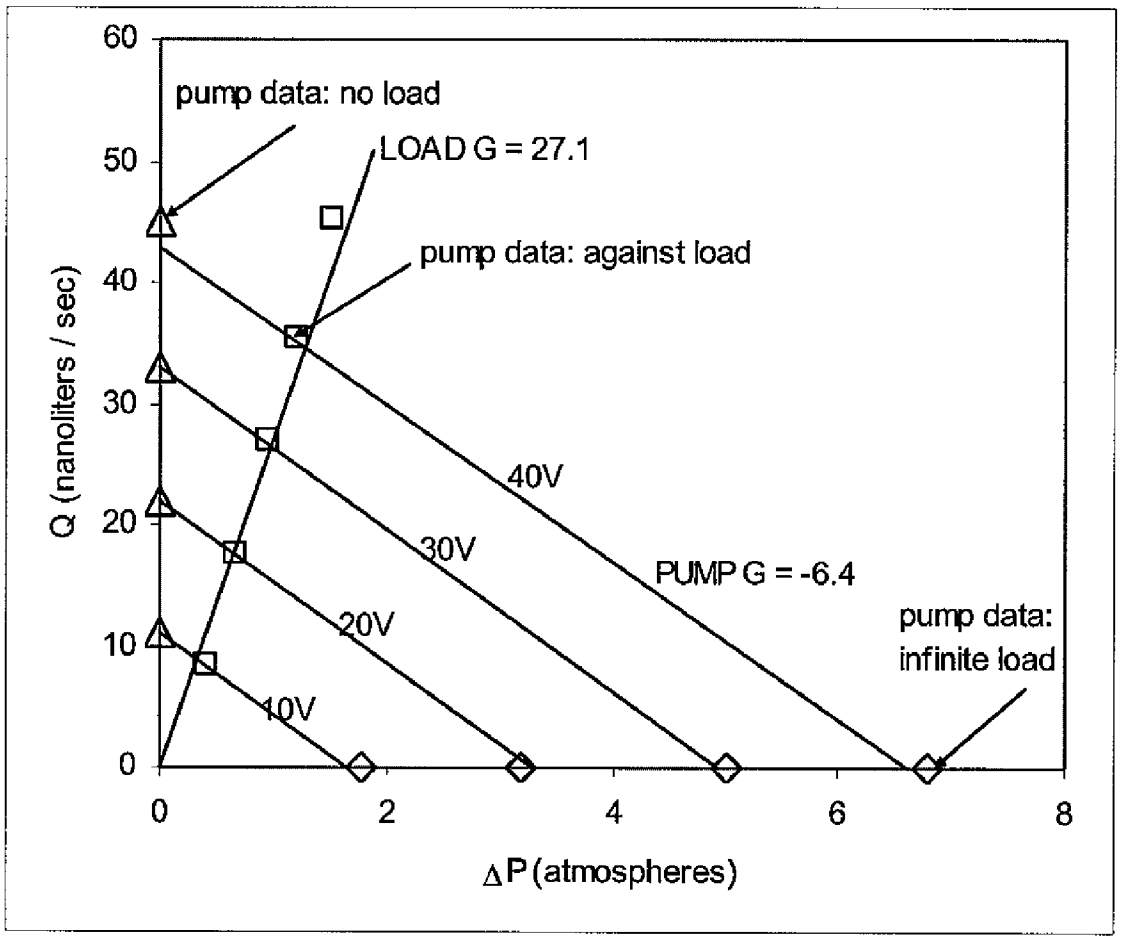
FIG. 5 shows flow characteristics of the device of FIG. 4A.

Pump Rate:

FIG. 5 shows the consolidated pump data for the trapezoidal injector and the rectangular fluid-receiving element of the FIG. 4 configuration and dimensions. The flow rate versus voltage with no load (vented operation) are shown as triangular data points. The pressure to stop flow versus voltage with infinite load (enclosed effluent chamber) are shown as rhombus data points. The pressure versus voltage during injection into a load are the square points.

The flow conductance of the injector GI and of the fluid-receiving load element GL was calculated using equations 3 and 4 respectively. These equations are obtained by differentiation of equation 1 and 2 for a trapezoidal injector and the rectangular load respectively.

$$G_I = \frac{dQ}{dP} = -\frac{\psi h(W-w)a^2}{8\eta L\tau \ln(W/w)} \quad \text{equation 3}$$

$$G_L = -\frac{dQ}{dP} = \frac{\psi hwa^2}{8\eta L\tau} \quad \text{equation 4}$$

From these equations and the known porosity, pore radius and the element's dimensions shown in FIG. 4 an injector conductance of −6.4 nanoliters/second/atmosphere and the total load conductance of 27 nanoliters/second/atmosphere was determined. These calculated pump and load conductance lines are also shown in FIG. 5. The fluidic equivalent circuit of the injector and fluid-receiving element is shown in FIG. 4. From the graph of FIG. 5 it is possible to obtain the injection speed through any receiving fluidic element when connected to the injector, knowing its flow conductance. The location of intersection of the load conductance line with the injector conductance line at a given voltage indicates both the air pressure in the air chamber driving fluid flow through the receiving element and the rate of fluid flow through the element. The rate of flow through a load is given by the maximum pump rate at zero load (vented operation) multiplied by GL/(GL+GI). Whenever the injector's conductance is much smaller than the conductance of the fluid-receiving element (including the conductance of the fluidic circuits serially connected thereto), GI<<GL, the injector's pump rate will be close to the injector's maximal pump rate at zero load (vented operation) and the pump rate will be relatively independent of the value of the load conductance of the fluid-receiving element and fluidic circuitry connected thereto, particularly important in the case that the load conductance changes during the injection operation or from device to device. Preferred circuits of this invention therefore should be designed to operate close to this condition. To achieve this condition the injector's conductance, GI should be minimized by selecting a small pore radius material (symbol 'a' of equation 3), while the receiving element and fluidic circuits connected thereto should prefer a larger pore radius.

To further illustrate this point, consider the device of FIG. 4 and its equivalent circuit. The maximum pump rate with no load is reduced by a factor 27/(27+6.4)=0.81 with the load connected. Suppose the receiving fluidic element was initially filled by a sample fluid of variable viscosity in the range 0.001<<0.002 Pa·s. The receiving element's conductance is 27 nanoliters/sec/atm. when=0.001, while it is 13.5 nanoliters/sec/atm. when=0.002. If the receiving element was initially filled with a sample of viscosity=0.002 and it receives an injected fluid of viscosity=0.001, the pump rate increases from 0.68 of its maximum rate to 0.81 of its maximum rate as the more viscous sample fluid is replaced by the less viscous injected fluid. The pump rate will similarly change from device to device as different sample fluids with differing viscosities are assayed. The reproducibility of the pump rate with variable load of a useful device will be determined by the requirements of a particular diagnostic assay format, but, typically for an injector connected to a receiving element which initially contains a sample fluid the injector's conductance should be less than about 0.05 of the receiving element's conductance. With GI=0.05GL the pump rate is 95% of the maximum pump rate in vented operation and quite invariant to changes in the load's conductance. For the injector of FIG. 4 with GI=6.4 the preferred minimum load conductance is therefore 128, the flow rate at the typical operating voltage of 40 volts is 44 nL/sec and the pressure in the air chamber driving flow through the load is 0.34 atmospheres above atmospheric pressure.

A useful injector pump speed is determined by the time to fill a fluid-receiving element in a diagnostic application of the device, being specified by the dimensions of the fluid-receiving element and on the time allowed to fill the receiving element as determined by the timing requirements for a particular assay format. The dimensions of a typical fluid-receiving element are 10 mm length×1 mm width×0.15 mm height and 0.7 porosity, for a volume of about 1000 nL. A representative useful pump speed is one at which the time to fill the typical fluid-receiving element is about 50 seconds or less i.e. a useful pump speed of at least 20 nL/s. Short path length pumps (L<3 mm) can operate to this specification at low voltage (V<12 volts). Longer path length pumps (3 mm<L<6 mm) require somewhat larger pump voltages (12<V<25 volts). Longer path lengths still (6 mm<L<12 mm) require even larger voltages (26<V<50 volts). A wider pump will deliver a higher flow rate, but if the dimensions of the effluent end of the pump are constrained by the dimensions of the fluid-receiving element then the optimal high speed pump is a trapezoid, being wide at its fluid application end and narrower at its effluent end.

Leakage Rate:

An injector of this invention can be characterized as being in one of two states: an off-state when no pump power is applied and an on-state when pump power is applied to the integral electrodes. In the initial off-state the injector is isolated from other fluidic elements by the air gap isolation means at its effluent end. In the ideal initial off-state there is no leakage flow across the air gap isolation means. In the on-state there is fluid flow beyond the injector's effluent end. In the ideal on-state the fluid flow rate should be dependent only on the applied pump power and not on the flow resistance of the fluid-receiving element to which the injector is connected, nor on the pressure difference across the input and effluent ends of the injector as may arise during the normal operation of the pump. In the ideal off-state after pumping there should be no further leakage-flow into or from the injector so that the position of the injected fluid in downstream fluidic elements such as the micro-reactor is stable for the duration of the off-state.

The magnitude of the injector's off-state leakage rate determines the effectiveness of the injector's air gap isolation means during the use of the fluidic circuit of the device before the injector is used, and the positional stability of the fluid after pumping by the injector. The air gap isolation means is sized so that the total amount of fluid that might leak in or out through the injector' effluent end during the time that the injector is in its initial off-state (during which time the injector is required to be isolated from neighbouring fluid-receiving elements) is insufficient to cause a fluid to traverse the air gap isolation means (and contact the neighbouring fluidic element). While it might be possible to isolate a very leaky pump by a large volume air gap, the negative consequence of this is that there is an extra amount of time taken to fill a large air gap volume when operating the injector in its on-state. An injector's leakage rate is determined by the injector's flow resistance and the pressure difference across the injector during its off-state as may arise during the normal operation of the fluidic circuit incorporating the injector. A pressure difference may be created during fluid flow through neighbouring fluidic devices (which may be typically of the order of 10,000 Pascal or 0.1 atmospheres above ambient when an injector is connected to fluid-receiving elements that are being driven by pressurized flow, for example by a neighbouring injector) or when there is a capillary wetting force due to interaction between the injector's fluid and active surfaces close to its effluent end (which are smaller, being typically 100 Pascal).

Using a diagnostic device of the invention incorporating an injector there is a period of time after the injector has been primed with fluid during which time it is isolated, this period being typically up to about 200 seconds but sometimes being as long as 500 seconds. During this time period it is required that the isolation means at the injector's effluent end does not fill when the injector's flow rate is its off-state leakage flow rate. It is further required that, during the subsequent pumping when the injector is in its on-state that the isolation means can be traversed in typically only about a few seconds or less by fluid being electro-osmotically injected to an adjacent fluid-receiving element. For example if it is required to inject 1000 nanoliters of fluid into a typically dimensioned fluid-receiving element in about 50 seconds or less, corresponding to a typical pump rate of 20 nanoliters/second, and when the air gap is about 10% of the fluid-receiving element's volume (also a typical value) the air gap is traversed in 5 seconds in the on-state. Thus, for a useful injector, the ratio of the on state flow to the off state leakage flow should be of the order of 200/5=40 or larger, but at a minimum it should be greater than 20. In the more general case the specification for the ratio of flow rate to leakage rate will be larger if the initial isolation time period is longer. For example for an isolation time of 500 seconds (say for example the time of an extended capture step taking place in a micro-reactor preceding a fluid injection step from an injector) the ratio of flow rate to leakage rate must be 100 for the same fluid-receiving element and air gap isolation means geometry. The off-state leakage after pumping can be determined in a similar fashion. If the volume of fluid in the fluid-receiving element that fills in 50 seconds during on-state pumping must be stable to about 10% over the duration of 200 seconds of an incubation step when the pump is in the off-state, the ratio of flow rate to leakage rate must be 40. For 5% stability the ratio should be 80. In conclusion, an injector of this invention must have a flow to leakage rate of at least 20 to be marginally useful and 40 for a typical application and 100 for an extreme case.

The ratio of the on state to off-state flow is derived from equation 1 and given by the equation below $$\frac{Q}{Q_{V=0}} + 1 = \frac{8\eta V\mu}{Pa^2} \qquad \text{equation 5}$$

This ratio depends on the pore radius a of the micro-porous injector flow path element, the pressure difference P across the injector that may arise during normal operation as well as on the normal operating pump voltage V. The injector's leakage was rated to a pressure difference of 100 Pa (10−3 atmospheres or about 1 cm head of water) when they are connected to a fluid-receiving element at a vented air chamber and 10,000 Pa (0.1 atmospheres) when they are connected to a fluid-receiving element at an enclosed air chamber and the receiving element supports pressure driven flow. In the table shown below we have calculated from equation 2 the critical pore radius and operating voltage required to achieve a flow rate ratio at its typical operation specification of 40 and at a value of 100 representing an extreme case specification requirement, for the two pressure ratings

| | η | Pa · s | | | | | 0.001 | | |
|---|---|---|---|---|---|---|---|---|---|
| | $\mu_{eo}$ | $m^2/V \cdot s$ | | | | | 2E−08 | | |
| | V volts | 1 | 5 | 9 | 12 | 40 | 100 | 20,000 | 50,000 |
| P = 100 | | | | | | | | | |
| $Q/Q_{v=0} = 40$ | a μm | 0.20 | 0.45 | 0.60 | 0.69 | 1.3 | 2.0 | 28 | 45 |
| $Q/Q_{v=0} = 100$ | | 0.13 | 0.28 | 0.38 | 0.44 | 0.8 | 1.3 | 18 | 28 |
| P = 10000 | | | | | | | | | |
| $Q/Q_{v=0} = 40$ | a μm | 0.02 | 0.04 | 0.06 | 0.07 | 0.13 | 0.20 | 2.8 | 4.5 |
| $Q/Q_{v=0} = 100$ | | 0.01 | 0.03 | 0.04 | 0.04 | 0.08 | 0.13 | 1.8 | 2.8 |

This table indicates that an injector with a vented effluent, using a material with EOM=2×10−8 m2/volt-second operating with an aqueous injection fluid with viscosity 0.001 Pascal-seconds, when specified to operate at an on-state to off-state flow ratio of 40 (100) and operating against a 100 Pascal pressure difference, must have a pore radius of less than about 2.0 (1.3) micrometers to operate at a usefully low voltage of less than 100 volts, and preferably less than 0.7 (0.4) micrometers for 12 volts battery operation, and less than 0.4 (0.3) micrometers for 5 volts operation. An injector with an enclosed air chamber at its effluent experiencing 10,000 Pascals pressure difference and operating at a typical 40 volts requires a material with a pore radius of about 0.13 micrometers or less.

The small pore sizes required for injectors of this invention are typically not encountered in the micro-porous materials used in standard lateral flow diagnostic devices, nor in the open channel configuration of electro-osmotic pumps of the lab-on-a-chip technology. An injector constructed with a 28 micrometer radius open channel, as would be typical in a micro-fluidic device constructed in conventional lab-on-a-chip technology, would need to operate at 20,000 volts to achieve the typically required flow rate ratio of 40 and at 50,000 volts to achieve 100. Thus, standard open-channel pumps of the lab-on-a-chip prior art, because they are susceptible to leakage flow in the off-state, cannot be valved by a passive valving means using an air gap as described in the current invention, rather they must be valved by an active closure means.

The experimental data generally support the model calculations shown above. There is consistently lowest leakage from small pore radius injector materials. Off-state isolation of injectors with pore radius larger than a few micrometers was poor, particularly when the air chamber's surfaces close to the effluent end of the injector were active or when there was a surfactant in the injector fluid.

Priming of Injector with Fluid from Integral Reservoir

The fluidic module of the invention comprising injectors with integral electrodes and fluidic circuits connected thereto can be incorporated into a plastic card-housing also comprising an integral sealed fluid reservoir containing an injector priming fluid. The card-housing with fluidic module and integral fluid reservoir now comprises a one-step device with all reagents required for the assay being contained within a single integral unit. The fluidic module of the invention can be constructed on a standard printed circuit board substrate as described in the schematic configurations of FIGS. 1-4. In this case the integral electrodes' electrical contact locations to external contacting means are on the same side of the module's substrate as the fluidics. The fluidic module can also be constructed on a two sided flex circuit substrate, which substrate has through-substrate electrical connection vias, so that the fluidic circuitry can be constructed on the upper surface of the flex substrate and the contact locations to external contact means are on the lower surface. This is the preferred construction when incorporating the fluidic element into a card housing of the dimensions of a credit card, as shown schematically in FIGS. 6 and 6A.

Figure 6:
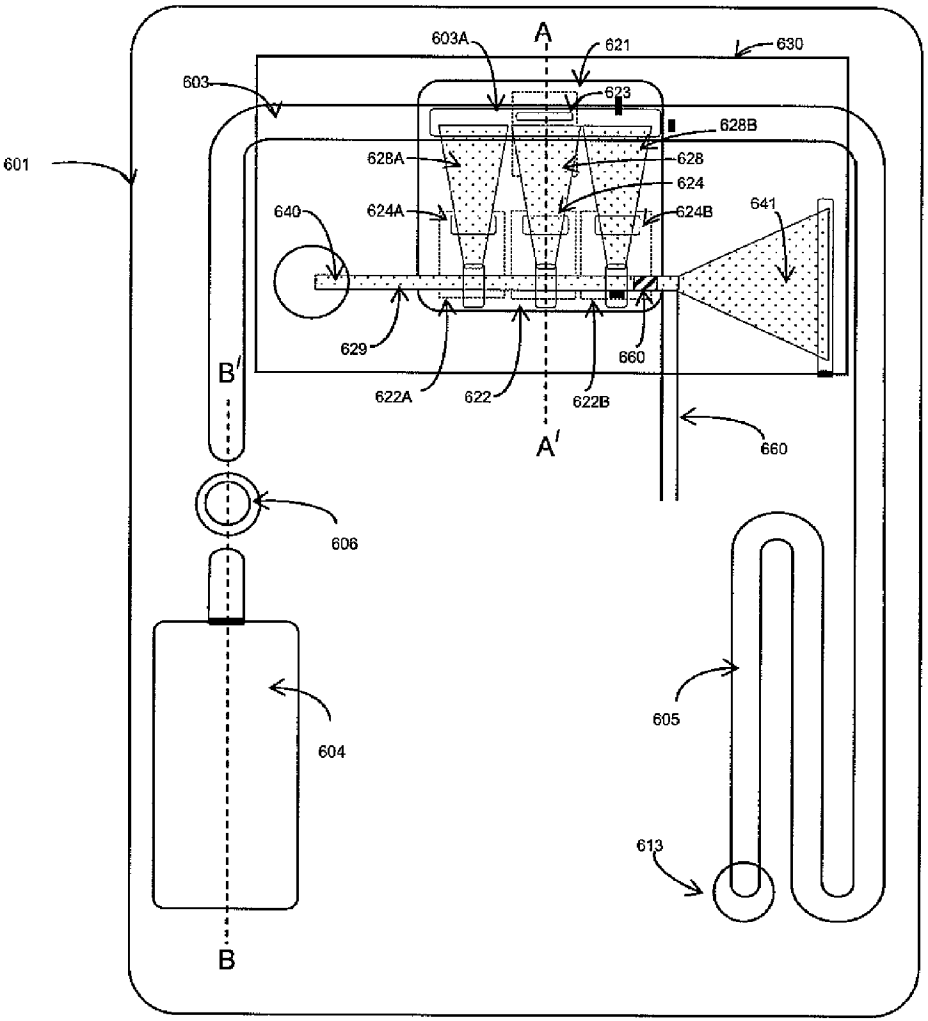
FIG. 6 is a top view schematic of a one-step diagnostic card incorporating a sample flow path with a multi-injector manifold and an integral sealed reservoir containing injector priming fluid.
Figure 6A:
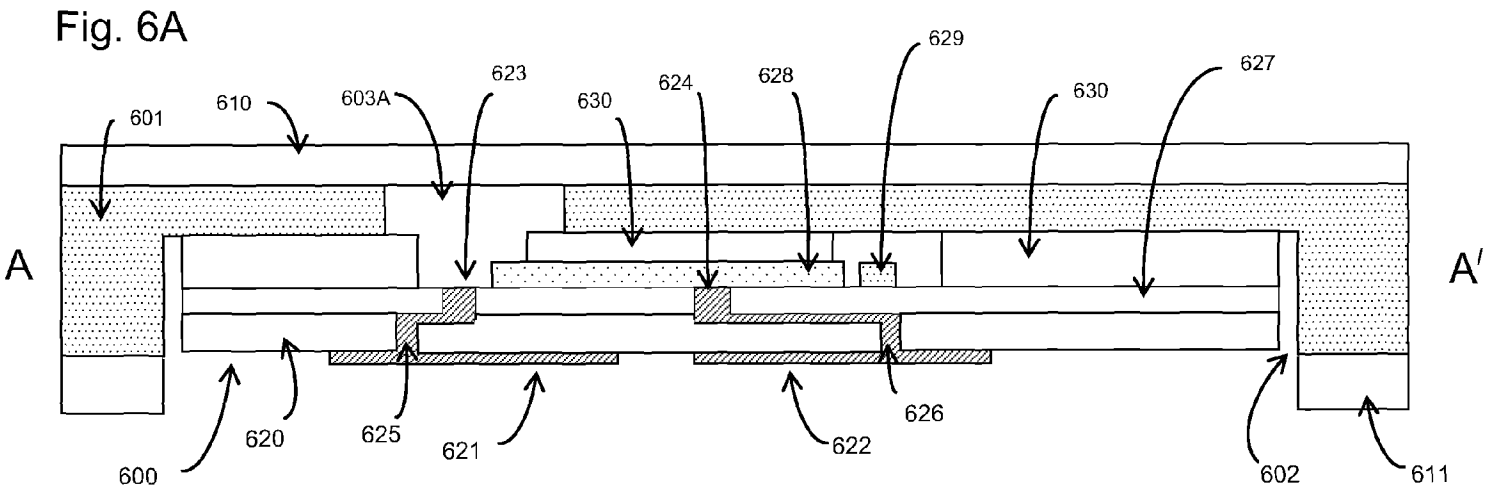
FIG. 6A-B show cross-sectional view schematics of the diagnostic card of FIG. 6.
Figure 6B:
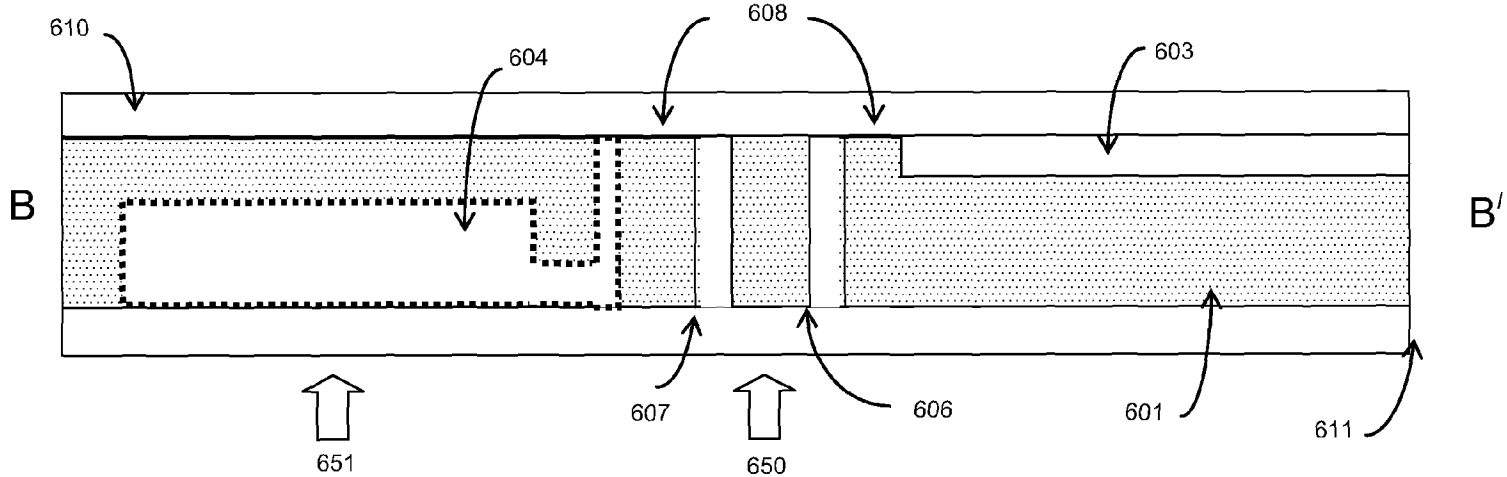

The device of FIG. 6 is a top view schematic of a credit card sized diagnostic card with a fluidic module and a sealed fluid reservoir embedded therein. FIG. 6A shows side view schematics through sections AA' and BB' of FIG. 6. The fluidic module has the same fluidic configuration as depicted in the schematic FIG. 2S, except the injectors are trapezoidal and the integral electrodes are connected through the substrate to external contacting means on the opposite side of the substrate to the fluidics. The diagnostic card comprises a molded plastic card housing 601. The molded housing has a fluid reservoir cavity 604 which is lined with an upper and lower polyethylene film coated aluminum foil liner. The cavity contains an aqueous buffer of low conductivity. The reservoir fluid is hermetically sealed by fusing the polyethylene coatings of the aluminum liners. The card housing also comprises a trough 603 with an input end located at a valve means 606 and an effluent end 605 with an air vent 613. The card housing further comprises a cavity 602 for accepting the fluidic module 600.

The fluidic module 600 comprises a module substrate of epoxy foil 620 with gold coated copper metallization on both sides. On the upper fluidic side of the module's substrate the metal has been formed into integral electro-osmotic pumping electrodes 623 and 624, 624A, 624B for contact to the injectors. On the lower side the metal has been formed into contact pads 621 and 622, 622A, 622B for contacting to an external electrical contact means. There are four metal-plated holes (two of which are 625, 626 shown in FIG. 6A) through the epoxy substrate which electrically connect electrodes on the upper side with contact pads on the lower side. The epoxy module with formed electrodes is made using standard flex circuit technology known in the art. There is a first sealing means 627 which is a die-cut adhesive element located on the epoxy modules upper surface. Element 627 covers the module surface except at locations 623, 624, 624A and 624B where the integral electrodes contact the injector's fluidic elements. There is a micro-porous strip element 629 over the first sealing layer. Element 629 has a sample application end 640 and a fluid collection element 641 of known fluid fill volume at its effluent end. There are also three micro-porous injector path elements 628, 628A and 628B whose effluent ends are separated from the strip element 629 by air gaps at three fluid-receiving locations along the length of the strip 629. The injectors' path elements are trapezoidal with a wide fluid application end and a narrow effluent end. A second sealing element 630 covers the micro-porous fluidic elements except at their fluid application and effluent ends, and except at the air chambers including the air gaps and fluid-receiving regions of 629 at the effluent ends of the injectors. A perimeter seal is formed around the micro-porous elements when the sealing means 627 and 630 are compressed around them.

In the final assembly the fluidic module 600 is inserted into housing cavity 602 and sealed to it. The card is further sealed to an upper die-cut laminate 610 and a lower die-cut laminate 611. In this step the housing element encloses the air chambers at the effluent ends of the injectors on the fluidic module and it encloses the molded trough 603 in the plastic card to form a fluidic channel.

During use a sample fluid is applied to the sample application end 640 of element 629 and it flows along the strip past a capture region 660 and into the fluid collection element 641. An analyte in the sample fluid is captured at the capture location. Next, the card is inserted into the card orifice of an instrument means. The card orifice has a planar surface comprising a slab with elements for engaging with the card on the card's lower surface. Upon card insertion the card's lower surface is parallel to the slab surface of the instrument's card insertion orifice and separated from it. The slab has embedded spring loaded electrical contacts proximal to the module's electrical contact pads and two elevated regions proximal to the card's fluid reservoir 604 and valve 606 when the card is inserted into the card orifice. When in the orifice the card is next brought into contact with the slab. Spring-loaded contact electrical elements now make contact with the module's electrical contact pads. A first slab elevation makes contact with the card at location 650 and pushes the plug 606 through the hole 607 in the card housing, thus detaching the top lamination seal at locations 608. A second slab elevation makes contact with the card at location 651, depressing the fluid reservoir and displacing fluid through detached seal region 608 into the channel 603. The fluid is displaced to the effluent end 605 of the channel filling the region 603A of the channel. Region 603A is the injectors' fluid application region. The fluid at this location now fills the injectors from their fluid application end to their effluent end by capillary wicking. Dry reagents in the injectors' effluent ends dissolve upon capillary filling. An instrument controlled voltage is applied to the first injector electrode 624A relative to the common ground electrode 621 contacting the fluid application region 603A, causing a first fluid containing a dissolved enzyme-labelled conjugate to be electro-osmotically injected along strip 629 including through capture region 660 to an effluent channel 670. The labelled conjugate is captured by the analyte at 660 thus labelling the captured complex. A second instrument controlled voltage is applied to the second injector electrode 624, causing a second wash fluid to be electro-osmotically injected along the strip including through the capture region. The wash fluid removes excess unbound conjugate. A third instrument controlled voltage is applied to the third injector electrode 624B, causing a third fluid containing an enzyme substrate to be electro-osmotically injected along the strip including through the capture region. When the substrate is a luminogenic substrate the reaction of the substrate with the enzyme label at location 660 creates a light signal which is measured by a light detector in the instrument means which is proximal to location 660 of the card, which light signal is proportionate to the concentration of the analyte in the sample.

EXPERIMENT 4

Electro-Osmotic Injection of Luciferase Chemiluminescence Reagents

In this experiment an injector configuration similar to the one depicted in FIG. 2Q except with a vented air chamber was used. In this device the injector was a trapezoidal element with dimensions 1 mm at the effluent orifice, 4 mm at the input orifice and 4.25 mm long by 0.15 mm thick, comprising micro-porous cellulose nitrate/acetate with 0.7 porosity and 0.11 pore radius. There was a vented air chamber which was a 1 mm wide channel at the injector's effluent end including a 0.5 mm long air gap separating the effluent end from the first fluid-receiving element. The first fluid-receiving element was a lateral flow strip with a centrally located fluid-receiving region, a sample application end and an effluent end. This element was 0.15 mm thickness by 1 mm wide by 8 mm long micro-porous polyethersulfone with 0.7 porosity and 0.25 micrometer pore radius. There was a second fluid-receiving element separated from the first by another 0.5 mm air gap. The second fluid-receiving element was a reaction region comprising a polyethersulfone pad 0.15 mm in thickness by 2 mm square that had been impregnated with a solution comprising ATP, luciferase, magnesium ion and buffers and allowed to dry. Assay reagents were obtained from Sigma Corporation.

The device was inserted into the insertion orifice of the instrument means A sample fluid containing luciferin to be assayed was applied to the fluid-receiving end of the first fluid-receiving element, and a injector priming fluid comprising 2 mM aqueous DEA to the fluid application region of the injector. The fluids filled the two elements up to their effluent ends. When each element was filled with fluid an instrument controlled voltage (40 volts) was applied to the injector's integral electrodes and fluid was pumped out of the effluent end of the injector (at 45 nanoliters/second). In this first injection step the injected fluid flowed for a period of time (about 20 seconds) sufficient for it to flow over the fluid-receiving region of the first fluid-receiving element and cover it, but not as far as the second fluid-receiving element, at which time the injector voltage was turned off. At this time the luciferin in the fluid-receiving region of the first fluid-receiving element diffused into the injected fluid in contact with it. In a second injection step applying a voltage (40 volts) to the injector for a time period of 20 seconds caused the fluid to move further so that it was now located over the second fluid-receiving element. There was a reaction between the luciferin in the injected fluid with luciferase in the second fluid-receiving element to generate a light signal measured by a light detector (5 mm×5 mm area photodiode with an amplification of 109 volts output per amp of photocurrent: from EOS Corporation) proximal to the second fluid-receiving element. A batch of identical diagnostic devices was used to test luciferin samples at various concentrations prepared by serial dilution in buffer. The number of moles of luciferin in the assay reaction was the concentration multiplied by the fluid volume of the injector fluid-receiving region of the sample strip.

The dose response curve of moles of luciferin versus light signal was linear over the dose range $6\times10^{-14}$ to $6\times10^{-11}$ moles, with a sensitivity of 4 mV of detector output per picomole of luciferin. This exemplar experiment was used determine the detection sensitivity of the second step of a two step assay format. The two step assay format will use an alkaline phosphatase label in a sandwich assay in which the labelled analyte complex is formed in a capture region of the sample fluid strip and in a first step luciferin phosphate substrate is electro-osmotically injected into the capture region producing luciferin. In a second step the luciferin is transported to the second fluid-receiving element where it reacts with luciferase to produce a detectable light signal. Based on the detector baseline 2SD variability of 8 microvolt a limit of detection of $2\times10^{-15}$ moles of luciferin can be estimated. For an alkaline phosphatase label producing 1000 moles/sec of luciferin from luciferin phosphate in excess we estimate a limit of detection of $2\times10^{-20}$ moles of label with 100 seconds of incubation. A volume of 10 microliters of a sample fluid containing an analyte at a concentration of $2\times10^{-15}$ M when labelled with one alkaline phosphatase molecule per analyte molecule contains $2\times10^{-20}$ moles of label. When the analyte is completely captured at the capture site there will be $2\times10^{-20}$ moles of captured alkaline phosphatase. The limit of detection determined by the detector sensitivity for a 10 microliter sample volume is thence a concentration of about $2\times10^{-15}$ M.

EXPERIMENT 5

Electro-Osmotic Injection of Dioxetane Substrate for Alkaline Phosphatase Chemiluminescence In this experiment, an injector configuration similar to the one depicted in FIG. 21 except with a vented air chamber, was used. In this device the injector was a trapezoidal element with dimensions 1 mm at the effluent orifice, 4 mm at the input orifice and 4.25 mm long by 0.15 mm thick, comprising micro-porous cellulose nitrate/acetate with 0.7 porosity and 0.11 pore radius. There was a vented air chamber which was a 1 mm wide channel at the injector's effluent end including a 0.5 mm long air gap separating the effluent end from the first fluid-receiving element. The first fluid-receiving element was a dry reagent application region containing a luminogenic dioxetane substrate for alkaline phosphatase (CDP-star obtained from Tropix Inc.). There was a second fluid-receiving element separated from the first by another 0.5 mm air gap. The second fluid-receiving element was a lateral flow strip with a centrally located fluid-receiving region, a sample application end and an effluent end. This element was 0.15 mm thickness by 1 mm wide by 8 mm long micro-porous nylon with 0.7 porosity and 0.25 micrometer pore radius. The element had been treated by blocking with BSA according to standard manufacturer's procedures prior to assembly in the device.

The device was inserted into the insertion orifice of the instrument means Sample fluid containing alkaline phosphatase to be assayed was applied to the fluid-receiving end of the second fluid-receiving element, and an injector priming fluid comprising 2 mM aqueous DEA to the fluid application region of the injector. The fluids filled the two elements up to their effluent ends. When each element was filled with fluid an instrument controlled voltage (40 volts) was applied to the injector's integral electrodes and fluid was pumped out of the effluent end of the injector at 45 nanoliters/second. In this injection step the injected fluid flowed for a period of time (15 seconds) sufficient for it to flow over the first fluid-receiving element and cover it, at which time the injector voltage was turned off. At this time, the luminogenic dioxetane substrate in the first fluid-receiving element dissolved into the injected fluid in contact with it. In a second injection step, applying a voltage (40 volts for 20 seconds) to the injector caused the fluid to move further so that it was now located over the second fluid-receiving element. There was a reaction between the dioxetane substrate in the injected fluid with alkaline phosphatase in the second fluid-receiving element generating a light signal measured by a light detector (5 mm×5 mm area photodiode with an amplification of 109 volts output per amp of photocurrent: device obtained from EOS Corporation) proximal to the second fluid-receiving element. A batch of identical diagnostic devices was used to test alkaline phosphatase samples at various concentrations prepared by serial dilution in buffer. The number of moles of alkaline phosphatase in the assay reaction was the concentration multiplied by the fluid volume of the injector fluid-receiving region of the sample strip.

The dose response curve of moles of alkaline phosphatase versus light signal was linear over the dose range $1\times10^{-14}$ to $1\times10^{-18}$ moles, with a sensitivity of 100 μV of detector output per attomole of alkaline phosphatase. This exemplar experiment was used determine the detection sensitivity of an alkaline phosphate label in a sandwich type ligand-binding assay. Based on the detector baseline 2SD variability of 5 microvolt we estimate a limit of detection of $5\times10-^{20}$ moles of alkaline phosphatase, or $5\times10-^{15}$ M in a 10 μL sample volume.

EXPERIMENT 6

Capture of Biotin-Conjugate to an Alkaline Phosphatase Label at a Streptavidin Capture Site and Signal Development Using an Electro-osmotically Pumped Dioxetane Substrate.

This is an example of a ligand binding assay performed in a lateral flow strip with an injector for supplying luminogenic substrate. In this experiment the configuration of the device is similar to the one depicted in FIG. 2I. The injector was a trapezoidal element with dimensions 1 mm at the effluent orifice, 4 mm at the input orifice and 4.25 mm long by 0.15 mm thick, comprising micro-porous cellulose nitrate/acetate with 0.7 porosity and 0.11 pore radius. There was a vented air chamber which was a 1 mm wide channel at the injector's effluent end including a 0.5 mm long air gap separating the effluent end from the first fluid-receiving element. The first fluid-receiving element was a dry reagent application region containing a luminogenic dioxetane substrate for alkaline phosphatase (CDP-star obtained from Tropix Inc.). There was a second fluid-receiving element separated from the first by another 0.5 mm air gap. The second fluid-receiving element was a lateral flow strip with a centrally located fluid-receiving region, a sample application end and an effluent end. This element was 0.15 mm thickness by 1 mm wide by 8 mm long micro-porous nylon with 0.7 porosity and 0.25 micrometer pore radius. The element was first treated by applying stretavidin to a 1 mm long capture location centrally located along the length of the strip (by impregnating 600 nanoliters of a solution containing 10 mg/liter) then treated by blocking with SUPERBLOCK (Pierce Biotechnology Inc) according to manufacturer's recommended procedures prior to assembly in the device.

The device was inserted into the insertion orifice of the instrument means. 6 microliters of a sample fluid containing biotin conjugated with an alkaline phosphatase label at a concentration to be assayed (in the range 0.1 to 50 pM) were added to the fluid-receiving end of the second fluid-receiving element, and an injector priming fluid comprising 2 mM aqueous DEA was applied to the fluid application region of the injector. The fluids filled the two elements up to their effluent ends. When each element was filled with fluid an instrument controlled voltage (40 volts) was applied to the injector's integral electrodes and fluid was pumped out of the effluent end of the injector at 45 nanoliters/second. In this injection step the injected fluid flowed for a period of time (15 seconds) sufficient for it to flow over the first fluid-receiving element and cover it, at which time the injector voltage was turned off. At this time the luminogenic dioxetane substrate in the first fluid-receiving element dissolved into the injected fluid in contact with it. In a second injection step, applying a voltage (40 volts for 20 seconds) to the injector caused the fluid to move further so that it was now located over the second fluid-receiving element. There was a reaction between the dioxetane substrate in the injected fluid with alkaline phosphatase in the capture complex in the second fluid-receiving element generating a light signal measured by a light detector (5 mm×5 mm area photodiode with an amplification of 109 volts output per amp of photocurrent: device obtained from EOS Corporation) proximal to the second fluid-receiving element. A batch of identical diagnostic devices was used to test samples of biotin conjugated to alkaline phosphatase at various concentrations prepared by serial dilution in buffer. The assay gave a linear response with 100 microvolts of diode signal per picomolar concentration of biotin. The limit of detection determined by the detector's baseline 2 standard deviation variability of 5 microvolts was determined to be a concentration of $5\times10^{-14}$ M.

EXPERIMENT 7

Capture of Biotin Conjugated to an Alkaline Phosphatase Label at a Streptavidin Capture Site and Signal Development Using an Electro-Osmotically Pumped Dioxetane Substrate This is a second configuration of an exemplar ligand binding assay performed in a lateral flow strip with an injector for supplying luminogenic substrate. In this experiment the configuration of the device is similar to the one depicted in FIG. 2I. In this device the injector was a trapezoidal element with dimensions 1 mm at the effluent orifice, 4 mm at the input orifice and 4.25 mm long by 0.15 mm thick, comprising micro-porous cellulose nitrate/acetate with 0.7 porosity and 0.11 pore radius. There was an enclosed air chamber at the injector's effluent end at the location of connection with the two fluid receiving elements. This air chamber was a 0.6 mm wide by 200 micrometers high channel connected at the injector's effluent end traversing the two fluid receiving elements and terminating in an enclosed chamber which was 2 mm wide by 10 mm long by 200 micrometers high. There was a 0.5 mm long air gap separating the injector's effluent end from a 0.6 mm wide by 1.5 mm long first fluid receiving element. The first fluid receiving element was a dry reagent application region containing a luminogenic dioxetane substrate for alkaline phosphatase (CDP-star obtained from Tropix Inc.). There was a second fluid receiving element separated from the first by another 0.5 mm air gap. The second fluid receiving element was a lateral flow strip with a centrally located fluid receiving region, a sample application end and an effluent end. This element was 0.15 mm thickness by 2 mm wide by 11 mm long micro-porous nylon with 0.7 porosity and 5 micrometer pore radius (Osmonics: Magna membrane). The element was first treated by applying streptavidin to a 2 mm wide by 1 mm long capture region located along the length of the strip at a location in the strip between its central fluid receiving region and its effluent end (by impregnating 600 nanoliters of a solution containing 10 mg/liter) then treated by blocking with Superblock (Pierce Biotechnology Inc) according to the manufacturer's recommended procedures prior to assembly in the device.

The device was inserted into the insertion orifice of the instrument means. 6 microliters of a sample fluid containing biotin conjugated with an alkaline phosphatase label at a concentration to be assayed (in the range 0.1 to 50 pM) were applied to the fluid receiving end of the second fluid receiving element, and an injector priming fluid comprising 2 mM aqueous DEA to the fluid application region of the injector. The fluids filled the two elements up to their effluent ends. As sample fluid filled the second fluid receiving element, the fluid flowed over the capture location of the strip and the biotin with alkaline phosphatase conjugate was captured at the capture location. When each element was filled with fluid an instrument controlled voltage (40 volts) was applied to the injector's integral electrodes and fluid was pumped out of the effluent end of the injector at 45 nanoliters/second. In this injection step the injected fluid flowed for a period of time (15 seconds) sufficient for it to flow over the first fluid receiving element and cover it, at which time the injector voltage was turned off. At this time the luminogenic dioxetane substrate in the first fluid receiving element dissolved into the injected fluid in contact with it. In a second injection step applying a voltage (40 volts for 20 seconds) to the injector caused the fluid to move into the second fluid receiving element and through it towards its effluent end so that it was now located in the capture region of the strip. There was a reaction between the dioxetane substrate in the injected fluid with alkaline phosphatase in the capture complex in the second fluid receiving element generating a light signal measured by a light detector (5 mm×5 mm area photodiode with an amplification of 1010 volts output per amp of photocurrent: device obtained from EOS Corporation) proximal to the second fluid receiving element. A batch of identical diagnostic devices was used to test samples of biotin conjugated to alkaline phosphatase at various concentrations prepared by serial dilution in buffer. The assay gave a linear response with 243 femtoamps of diode signal per picomolar concentration of biotin. The limit of detection determined by the detector's baseline 2 standard deviation variability of 1 femtoamp was determined to be a concentration of 4×10−15 M.

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A micro-assay device comprising:

a micro-reactor for sample fluid analysis;

a first fluidic element for introducing a sample fluid into the micro-reactor; and an injector fluid pump for pushing the sample fluid along a sample fluid flow path of the micro reactor, the injector fluid pump including an initially closed integral injector fluid reservoir containing an aqueous injector fluid;

an initially dry microporous injector fluid flow path having an injector fluid application end for accepting the injector fluid from the reservoir and an injector fluid effluent end for connecting to the sample fluid flow path, the injector fluid flow path automatically filling with the injector fluid up to the effluent end upon supply of the injector fluid to the injector fluid application end;

a valve for opening the reservoir and selectively supplying the injector fluid from the reservoir to the injector fluid application end;

an isolator for preventing passive injector fluid flow from the effluent injector fluid into the sample fluid flow path when the injector fluid flow path includes the injector fluid;

driving means for electro-osmotically pumping the injector fluid in the injector fluid flow path across the isolator to force the injector fluid into the sample fluid flow path, when the sample fluid flow path includes the sample fluid, for advancing the sample fluid in the sample fluid flow path by hydraulically pushing the sample fluid along the sample fluid flow path with the injector fluid; and a sealing element for sealing the injector fluid flow path along a perimeter thereof to prevent flow of the injector fluid from the injector fluid flow path at the perimeter during electro-osmotic pumping of the injector fluid.

2. The micro-assay device of claim 1, wherein the first fluidic element for introducing the sample fluid into the micro-reactor is a micro-channeled, micro-porous element which is initially dry and contains a mobilizable reagent.

3. The micro-assay device of claim 2, wherein the mobilizable reagent is selected from the group of luminogenic, fluorogenic, electrogenic and chemoluminescent substrates and combinations thereof.

4. The micro-assay device of claim 1, wherein the injector fluid effluent end of the injector fluid flow path, the air gap and the first fluidic element for introducing the sample fluid into the micro-reactor are sealed in an enclosing chamber containing air and being sealed from ambient.

5. The micro-assay device of claim 1, wherein the injector fluid effluent end of the injector fluid flow path, the air gap and the first fluidic element for introducing the sample fluid into the micro-reactor are sealed in an enclosed chamber containing air and being vented through an air vent channel.

6. The micro-assay device of claim 1, wherein the micro-reactor is located along a length of the first fluidic element.

7. The micro-assay device of claim 1, wherein the first fluidic element and the injector fluid flow path of the injector pump are micro-fabricated on a planar substrate.

8. The micro-assay device of claim 1, wherein the first fluidic element and the injector fluid flow path of the injector pump are formed from membrane sheets by die cutting.

9. The micro-assay device of claim 1, further comprising:

an electrically-insulated substrate; wherein the micro-reactor for sample fluid analysis is located on the electrically-insulated substrate; and the first fluidic element includes a network of N input flow paths on the electrically-insulated substrate for supplying fluids to the micro-reactor; and a network of M effluent flow paths on the electrically-insulated substrate for removing fluids from the micro-reactor, wherein at least one of the N, M flow paths is the injector pump.

10. The micro-assay device of claim 9, wherein the injector fluid effluent end of the injector pump, the isolator and the fluid receiving location of the micro-reactor are enclosed in a vented air chamber.

11. The micro-assay device of claim 9, wherein the injector fluid effluent end of the injector pump, the isolator and the fluid receiving location of the micro-reactor are enclosed in a sealed air chamber.

12. The micro-assay device of claim 9, wherein the fluid receiving device is a micro-porous lateral flow strip with a fluid receiving location along its length.

13. The micro-assay device of claim 12, wherein the lateral flow strip has a sample fluid application end and an effluent end.

14. The diagnostic device of claim 12, wherein the mobilizable reagent is a labelled conjugate.

15. The micro-assay device of claim 9, wherein one or more of the N, M flow paths is initially dry and contains a mobilizable reagent.

16. The micro-assay device of claim 15, wherein the mobilizable reagent is selected from the group of luminogenic, fluorogenic, electrogenic and chemoluminescent substrates and combinations thereof.

17. The micro-assay device of claim 9, wherein one or more of the micro-reactors is a channel which is fluidically connected to a region of the first fluidic means or to a region of the injector fluid flow path of the injector pump.

18. The micro-assay device of claim 9, wherein one or more of the micro-reactors is located along one of the N input paths.

19. The micro-assay device of claim 9, wherein one or more of the micro-reactors is located along a length of the M input paths.

20. The micro-assay device of claim 9, wherein one or more of the M effluent flow paths is a micro-porous element which is initially dry and contains a mobilizable reagent.

21. The micro-assay device of claim 9, wherein one or more of the N input flow paths is a micro-porous element which is initially dry and contains a mobilizable reagent.

22. The micro-assay device of claim 9, wherein one or more of the N, M flow paths is capillary-dimensioned and is produced by micro-fabrication on the planar substrate.

* * * * *